US012276184B1

(12) United States Patent
Ejim et al.

(10) Patent No.: US 12,276,184 B1
(45) Date of Patent: Apr. 15, 2025

(54) REVIVING A WELL USING THROUGH-TUBING CABLE-DEPLOYED PUMP

(71) Applicant: SAUDI ARABIAN OIL COMPANY, Dhahran (SA)

(72) Inventors: Chidirim Enoch Ejim, Dhahran (SA); Hattan M. Banjar, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 11 days.

(21) Appl. No.: 18/487,890

(22) Filed: Oct. 16, 2023

(51) Int. Cl.

| | |
|---|---|
| ***E21B 43/12*** | (2006.01) |
| ***E21B 23/06*** | (2006.01) |
| ***E21B 23/14*** | (2006.01) |
| *E21B 47/07* | (2012.01) |
| *E21B 47/10* | (2012.01) |

(52) U.S. Cl.
CPC ..... *E21B 43/128* (2013.01); *E21B 23/06* (2013.01); *E21B 23/14* (2013.01); *E21B 47/07* (2020.05); *E21B 47/10* (2013.01)

(58) Field of Classification Search
CPC ..... E21B 43/128
See application file for complete search history.

(56) References Cited

U.S. PATENT DOCUMENTS

2019/0085667 A1* 3/2019 Xiao ..... F04D 1/066
2020/0362684 A1* 11/2020 Brown ..... E21B 43/38

FOREIGN PATENT DOCUMENTS

CA 2 971 030 A1 12/2017

OTHER PUBLICATIONS

Tendeka, "Retrievable SwellRight Packer Datasheet"; <https://www.tendeka.com/wp-content/uploads/Retrievable-SwellRight-Packer-Datasheet.pdf>; Accessed Oct. 13, 2023 (1 page).
Wrighton, Christopher et al., "A Novel Technique to Revive Killed Wells Back into Production"; Proceedings of the International Petroleum Technology Conference; Paper No. IPTC-20196-Abstract; pp. 1-16; Jan. 13, 2020 (16 pages).

* cited by examiner

*Primary Examiner* — William D Hutton, Jr.
*Assistant Examiner* — Avi T Skaist
(74) *Attorney, Agent, or Firm* — Osha Bergman Watanabe & Burton LLP

(57) ABSTRACT

A method that includes disposing a packer and an ESP inside a production tubing bore. The ESP includes a pump, a discharge, a shroud, and a bypass sub coupled to the shroud. The shroud includes a closed end coupled to a base of the pump. The packer, coupled to an outer surface of the shroud, is located downstream of the bypass sub. The method includes circulating liquids from the pumping base through the discharge to a shroud open end downstream of the packer thereby sealing the packer between the outer surface and the production tubing bore. The method includes pumping, using the pump device, the liquids through the production tubing using the bypass sub and performing a production operation using the wellhead assembly to obtain an amount of gas production.

23 Claims, 14 Drawing Sheets

REVIVING A WELL USING THROUGH-TUBING CABLE-DEPLOYED PUMP

BACKGROUND

The disclosure relates generally to production of fluid from subterranean reservoirs. More particularly, the disclosure relates to the use of electrical submersible pump (ESP) assemblies that reduce gas accumulation of the fluid intakes.

Fluids are typically produced from a reservoir in a subterranean formation by drilling a wellbore into the subterranean formation, establishing a flow path between the reservoir and the wellbore, and conveying the fluids from the reservoir through the wellbore to a destination such as to the surface of the earth, to a bed of a body of water such as a lakebed or a seabed, or to a surface of a body of water such as a swamp, a lake, or an ocean (hereafter "surface.") Fluids produced from a hydrocarbon reservoir may include natural gas, oil, and water. Typically, a production tubing is disposed in the wellbore to carry the fluids to the surface.

In some formations, pressure within the rock formation causes the resources to flow naturally from the formation to the surface. One common challenge in producing fluids from a hydrocarbon reservoir through a wellbore is that, in some formations, the pressure in the formation is not adequate to cause the flow against gravity out of the formation to the surface or is not adequate to cause the flow to meet flowrate goals. In such instances, artificial lift technology can be used to add energy to fluid to bring the resources to the surface.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, a method that includes disposing a packer and an electrical submersible pump assembly (ESP) in a production tubing with a production tubing bore. The ESP includes a pump device, a discharge, a shroud, and a bypass sub coupled to the shroud. The shroud includes a closed end that is coupled to a pumping base of the pump device. The packer is coupled to an outer surface of the shroud, and the packer is located downstream of the bypass sub. The production tubing is in fluid communication with well fluids containing gases and liquids and the production tubing is configured for delivering the gases and the liquids into a wellhead assembly through the production tubing bore. The method includes circulating, using the pump device, the liquids from the pumping base through the discharge, which is coupled to a pump outlet. The liquids continue to a shroud open end of the shroud. The shroud open end is downstream of the packer. The method includes forming, using the packer, a seal between the outer surface and the production tubing bore. The method includes pumping, using the pump device, the liquids through the production tubing using the bypass sub and performing a production operation using the wellhead assembly to obtain an amount of gas production.

This disclosure presents, in accordance with one or more embodiments, a system that includes a packer and an electrical submersible pump assembly (ESP) disposed in a production tubing with a production tubing bore. The ESP includes a pump device, a discharge, a shroud, and a bypass sub coupled to the shroud. The shroud includes a closed end configured to be coupled to a pumping base of the pump device. The packer is configured to be coupled to an outer surface of the shroud. The packer is located downstream of the bypass sub. The production tubing is in fluid communication with well fluids containing gases and liquids and the production tubing is configured for delivering the gases and the liquids into a wellhead assembly through the production tubing bore. The system includes a pump outlet coupled to the discharge configured to direct liquids pumped by the pump device from the pumping base through the discharge to a shroud open end.

Other aspects and advantages of the claimed subject matter will be apparent from the following description and the appended claims.

DETAILED DESCRIPTION

Figure 1:
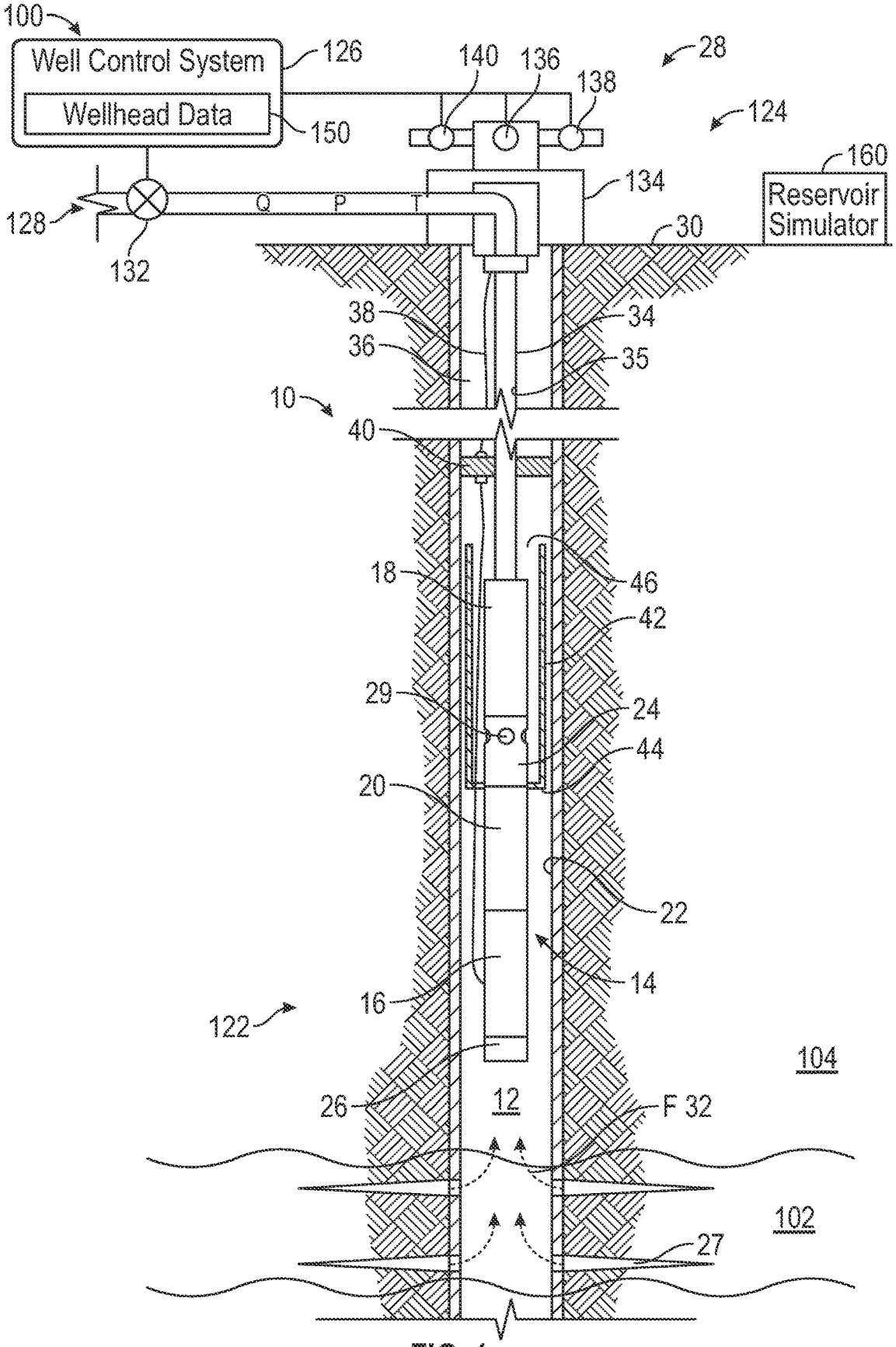
FIG. 1 shows a system for producing hydrocarbons in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

For bringing liquids out of a subterranean wellbore to the surface of the Earth, various techniques such as artificial lift technology may be used. Artificial lift technology may include, for example, a pump and associated components to assist in lifting the fluids up the wellbore. As an example, production tubing associated with the wellbore may include one or more pumps to assist in lifting the fluids up the wellbore. The pump may be electrically operated and located submerged in the fluid at or near the bottom of the well. The pump system may use a surface or seabed power source to drive the submerged pump assembly. Alternatively, power for the pump may be provided at another location downhole in the well, such as a downhole fuel cell. These pump systems so configured are termed electric submersible pump (ESP) systems, with "ESP" being a term of art used in the industry, the field, the trade, associated literature, etc. Other terms of art include pumps coupled to production tubing known as tubing-deployed ESPs (TDESPs.) Pumps may be deployed on cable such as a cable reel or cable winch that may be coupled to a wireline unit. Pumps coupled to cable are known as cable-deployed ESPs (CDESPs.)

Notably, ESP performance may be impacted by various reservoir characteristics such as, for example, gas-oil ratio, water cut, flowing wellhead pressure (FWHP), well test liquid rate, and pump operating frequency. It is beneficial to be able to adjust parameters to optimize ESP performance. In particular, there exists a need for a method for optimizing the performance of ESPs in real time by recommending the optimum pump control settings to maximize pump operating efficiency and minimize overall power consumption for a determined target well rate. More terms of art include ESPs designed for use in high gas volume fraction (HGVF) environments known as HGVFPs. ESPs designed for ultra high-speed (UHS) operation are known as UHS ESPs. Cable-deployed, ultra high-speed, high gas volume fraction pumps are known as CD UHS HGVFPs.

As such, embodiments disclosed herein present systems and methods that may enable unloading liquids from a gas well using a CD UHS HGVFP. The apparatus and method may also be applied using any suitable pump, and also may be used to unload kill fluid or brine from oil wells using any suitable pump type. Unloading a well may be used to kick-off production from an oil or gas well. Unloading a gas well may use a CD UHS HGVFP. The pump may handle high intake gas-volume fractions (GVFs) up to 90%. Other CD UHS HGVFPs may handle GVFs greater than 90%. The system described is run as an intervention method through the production tubing of an existing gas well. The downhole assembly includes the pumping system as well as a retrievable swell packer and a bypass sub. The system is run-in-hole through the production tubing to access the loaded liquid either with or without use of a tail pipe. The pumping system is then powered on to recirculate liquid causing the retrievable swell packer to expand to form an annular seal with the production tubing. The liquid is lifted out of the well via the production tubing. The well is revived with the resulting increase in gas static pressure, causing the gas to preferentially flow through the bypass sub to surface. The system is retrieved to surface by pulling on the cable to disengage the retrievable swell packer from contact with the production tubing. For example, a cable reel such as a wireline unit cable reel or cable winch may be activated to pull on the cable and return the ESP system back to surface. The system offers benefits compared to current liquid unloading methods such as coiled tubing nitrogen injection, including a smaller foot print, reduced OPEX and HSE risks, ability to use a lubricator thereby facilitating installation and retrieval of the system in live gas well conditions, amongst other advantages. These benefits maximize production from gas wells and increases the operator's bottom line.

FIG. 1 shows a system for producing hydrocarbons in accordance with one or more embodiments. FIG. 1 shows a system (e.g., a wellsite 100) for producing hydrocarbons from subterranean well 10 through a wellhead assembly (e.g., wellhead 28). Subterranean well 10 includes a wellbore (e.g., a wellbore 12). Electrical submersible pump assembly (e.g. an ESP 14) is located within the wellbore. The wellbore can include outer tubular member 22, which can be, for example, a well casing or other large diameter well tubing. ESP 14 includes a motor 16 at or near the lowermost end of ESP 14. Motor 16 is used to drive a pump 18 at an upper portion of ESP 14. Between motor 16 and pump 18 is protector 20 and intake 24. Protector 20 can be used for equalizing pressure within ESP 14 with that of the wellbore, for providing a seal between intake 24 and motor 16, for containing an oil reservoir for motor 16, and for helping to convey the thrust load of the pump 18.

FIG. 1 shows a schematic diagram in accordance with one or more embodiments. As shown, FIG. 1 illustrates the wellsite 100 that includes a hydrocarbon reservoir (e.g., reservoir 102) located in a subsurface hydrocarbon-bearing formation (e.g., formation 104). The formation 104 may include a porous or fractured rock formation that resides underground, below the surface of the earth or below a seabed (hereafter surface e.g., surface 30). In the case of the well system being a hydrocarbon well, the reservoir 102 may include a portion of the formation 104. The formation 104 and the reservoir 102 may include different layers of rock having varying characteristics, such as varying degrees of permeability, porosity, and resistivity. In the case of the wellsite 100 being operated as a production well, the well system may facilitate the extraction of hydrocarbons from the reservoir 102.

In some embodiments, the wellsite 100 includes the wellbore (e.g., the wellbore 12), a well sub-surface system 122, a well surface system 124, and a well control system 126. The well control system 126 may control various operations of the wellsite 100, such as well production operations, well completion operations, well maintenance operations, and reservoir monitoring, assessment, and development operations. In some embodiments, the well control system 126 includes a computer system that is the same as or similar to that of computer system (e.g., a computer 1402) described below in FIG. 14 and the accompanying description.

The wellbore may include a bored hole that extends from the surface 30 into a target zone of the formation 104, such as the reservoir 102. An upper end of the wellbore, terminating at or near the surface 30, may be referred to as the "up-hole" end of the wellbore, and a lower end of the wellbore, terminating in the formation 104, may be referred to as the "downhole" end of the wellbore. The wellbore may facilitate the circulation of drilling fluids during drilling operations, the flow of hydrocarbon (e.g., oil and gas) production (e.g., production 128) from the reservoir 102 to the surface 30 during production operations, the injection of substances (e.g., water) into the formation 104 or the reservoir 102 during injection operations, or the communication of monitoring devices (e.g., logging tools) into the formation 104 or the reservoir 102 during monitoring operations (e.g., during in situ logging operations).

In some embodiments, during operation of the wellsite 100, the well control system 126 collects and records wellhead data 150 for the wellsite 100 and other data regarding downhole equipment and downhole sensors (e.g., using an automatic computer-controlled management system described herein.) The wellhead data 150 may include, for example, a record of measurements of wellhead pressure (P) (e.g., including flowing wellhead pressure (FWHP)), wellhead temperature (T) (e.g., including flowing wellhead temperature), wellhead production rate (Q) over some or all of the life of the wellsite 100, and water cut data. In some embodiments, the measurements are recorded in real-time, and are available for review or use within seconds, minutes, or hours of the condition being sensed (e.g., the measurements are available within one hour of the condition being sensed). In such an embodiment, the wellhead data 150 may be referred to as "real-time" wellhead data. Real-time wellhead data may enable an operator of the wellsite 100 to assess a relatively current state of the well and make real-time decisions regarding development of the well and the reservoir, such as on-demand adjustments in regulation of production flow from the well.

With respect to water cut data, the well surface system 124 may include one or more water cut sensors. For example, a water cut sensor may be hardware and/or software with functionality for determining the water content in oil, also referred to as "water cut." Measurements from a water cut sensor may be referred to as water cut data and may describe the ratio of water produced from the wellbore compared to the total volume of liquids produced from the wellbore. In some embodiments, a water-to-gas ratio (WGR) is determined using a multiphase flow meter. For example, a multiphase flow meter may use magnetic resonance information to determine the number of hydrogen atoms in a particular fluid flow. Since oil, gas and water all contain hydrogen atoms, a multiphase flow may be measured using magnetic resonance. In particular, a fluid may be magnetized and subsequently excited by radio frequency pulses. The hydrogen atoms may respond to the pulses and emit echoes that are subsequently recorded and analyzed by the multiphase flow meter.

In some embodiments, the well surface system 124 includes a wellhead 28. The wellhead 28 may include a rigid structure installed at the "up-hole" end of the wellbore, at or near where the wellbore terminates at the surface 30. The wellhead 28 may include structures for supporting (or "hanging") casing and production tubing extending into the wellbore. Production 128 may flow through the wellhead 28, after exiting the wellbore and the well sub-surface system 122, including, for example, the casing and the production tubing. In some embodiments, the well surface system 124 includes flow regulating devices that are operable to control the flow of substances into and out of the wellbore. For example, the well surface system 124 may include one or more of a production valve 132 that are operable to control the flow of production 128. For example, a production valve 132 may be fully opened to enable unrestricted flow of production 128 from the wellbore, the production valve 132 may be partially opened to partially restrict (or "throttle") the flow of production 128 from the wellbore, and production valve 132 may be fully closed to fully restrict (or "block") the flow of production 128 from the wellbore, and through the well surface system 124.

Keeping with FIG. 1, in some embodiments, the well surface system 124 includes a surface sensing system 134. The surface sensing system 134 may include sensor devices for sensing characteristics of substances, including production 128, passing through or otherwise located in the well surface system 124. The characteristics may include, for example, pressure, temperature, and flow rate of production 128 flowing through the wellhead 28, or other conduits of the well surface system 124, after exiting the wellbore.

In some embodiments, the surface sensing system 134 includes a surface pressure sensor 136 operable to sense the pressure of production 128 flowing through the well surface system 124, after it exits the wellbore. For example, the surface pressure sensor 136 may comprise a gas pressure sensor configured to record a gas pressure at the wellhead assembly. The surface pressure sensor 136 may include, for example, a wellhead pressure sensor that senses a pressure of production 128 flowing through or otherwise located in the wellhead 28. A measured wellhead pressure provides data that can be used to estimate a downhole pressure. In some embodiments, the surface sensing system 134 includes a surface temperature sensor 138 operable to sense the temperature of production 128 flowing through the well surface system 124, after it exits the wellbore. For example, the surface temperature sensor 138 may comprise a gas temperature sensor configured to record a gas temperature at the wellhead assembly. The surface temperature sensor 138 may include, for example, a wellhead temperature sensor that senses a temperature of production 128 flowing through or otherwise located in the wellhead 28, referred to as "wellhead temperature" (T). A measured wellhead temperature provides data that can be used to estimate a downhole temperature. In some embodiments, the surface sensing system 134 includes a flow rate sensor 140 operable to sense the flow rate of production 128 flowing through the well surface system 124, after it exits the wellbore. The flow rate sensor 140 may include hardware that senses a flow rate of production 128 (Q) passing through the wellhead 28.

Keeping with FIG. 1, when completing a well, one or more well completion operations may be performed prior to delivering the well to the party responsible for production or injection. Well completion operations may include casing operations, cementing operations, perforating the well, gravel packing, directional drilling, hydraulic stimulation of a reservoir region, and/or installing a production tree or wellhead assembly at the wellbore. Likewise, well operations may include open-hole completions or cased-hole completions. For example, an open-hole completion may refer to a well that is drilled to the top of the hydrocarbon reservoir. Thus, the well may be cased at the top of the reservoir and left open at the bottom of the wellbore. In contrast, cased-hole completions may include running casing into a reservoir region.

In one well completion example, the sides of the wellbore may require support, and thus casing may be inserted into the wellbore to provide such support. After a well has been drilled, casing may ensure that the wellbore does not close in upon itself, while also protecting the wellstream from outside contaminants, like water or sand. Likewise, if the formation is firm, casing may include a solid string of steel pipe that is run in the well and will remain that way during the life of the well. In some embodiments, the casing includes a wire screen liner that blocks loose sand from entering the wellbore.

In another well operation example, a space between the casing and the untreated sides of the wellbore may be cemented to hold a casing in place. This well operation may include pumping cement slurry into the wellbore to displace existing drilling fluid and fill in this space between the casing and the untreated sides of the wellbore. Cement slurry may include a mixture of various additives and cement. After the cement slurry is left to harden, cement may seal the wellbore from non-hydrocarbons that attempt to enter the wellstream. In some embodiments, the cement slurry is forced through a lower end of the casing and into an annulus between the casing and a wall of the bored hole of the wellbore.

Keeping with well operations, some embodiments include perforation operations. More specifically, a perforation operation may include perforating casing and cement at different locations in the wellbore to enable hydrocarbons to enter a wellstream from the resulting holes. For example, some perforation operations include using a perforation gun at one or more reservoir levels to produce holed sections through the casing, cement, and sides of the wellbore. Hydrocarbons may then enter the wellstream through these holed sections. In some embodiments, perforation operations are performed using discharging jets or shaped explosive charges to penetrate the casing around the wellbore.

In another well completion, a filtration system may be installed in the wellbore in order to prevent sand and other debris from entering the wellstream. For example, a gravel packing operation may be performed using a gravel-packing slurry of appropriately sized pieces of coarse sand or gravel. As such, the gravel-packing slurry may be pumped into the wellbore between a casing's slotted liner and the sides of the wellbore. The slotted liner and the gravel pack may filter sand and other debris that might have otherwise entered the wellstream with hydrocarbons. In another well completion, a wellhead assembly may be installed on the wellhead of the wellbore. A wellhead assembly may include a production tree (also called a Christmas tree) that includes valves, gauges, and other components to provide surface control of subsurface conditions of a well.

In some embodiments, the wellbore includes one or more casing centralizers. For example, a casing centralizer may be a mechanical device that secures casing at various locations in the wellbore to prevent casing from contacting the walls of the wellbore. Thus, casing centralization may produce a continuous annular clearance around casing such that cement may be used to completely seal the casing to walls of the wellbore. Without casing centralization, a cementing operation may experience mud channeling and poor zonal isolation. Examples of casing centralizers may include bow-spring centralizers, rigid centralizers, semi-rigid centralizers, and mold-on centralizers. In particular, bow springs may be slightly larger than a particular wellbore in order to provide complete centralization in vertical or slightly deviated wells. On the other hand, rigid centralizers may be manufactured from solid steel bar or cast iron with a fixed blade height in order to fit a specific casing or hole size. Rigid centralizers may perform well even in deviated wellbores regardless of any particular side forces. Semi-rigid centralizers may be made of double crested bows and operate as a hybrid centralizer that includes features of both bow-spring and rigid centralizers. The spring characteristic of the bow-spring centralizers may allow the semi-rigid centralizers to compress in order to be disposed in tight spots in the wellbore. Mold-on centralizers may have blades made of carbon fiber ceramic material that can be applied directly to a casing surface.

In some embodiments, well intervention operations may also be performed at a well site. For example, well intervention operations may include various operations carried out by one or more service entities for an oil or gas well during its productive life (e.g., hydraulic fracturing operations, coiled tubing, flow back, separator, pumping, wellhead and production tree maintenance, slickline, braided line, coiled tubing, snubbing, workover, subsea well intervention, etc.). For example, well intervention activities may be similar to well completion operations, well delivery operations, and/or drilling operations in order to modify the state of a well or well geometry. In some embodiments, well intervention operations are used to provide well diagnostics, and/or manage the production of the well. With respect to service entities, a service entity may be a company or other actor that performs one or more types of oil field services, such as well operations, at a well site. For example, one or more service entities may be responsible for performing a cementing operation in the wellbore prior to delivering the well to a producing entity.

Turning to the reservoir simulator 160, a reservoir simulator 160 may include hardware and/or software with functionality for performing a well simulation (e.g., well simulations of the wellbore of one or more wells) such as storing and analyzing well logs, production data, sensor data (e.g., from a wellhead, downhole sensor devices, or flow control devices), and/or other types of data to generate and/or update one or more geological models of one or more reservoir regions. Geological models may include geochemical or geomechanical models that describe structural relationships within a particular geological region. Likewise, a reservoir simulator 160 may also determine changes in reservoir pressure and other reservoir properties for a geological region of interest, e.g., in order to evaluate the health of a particular reservoir during the lifetime of one or more producing wells.

While the reservoir simulator 160 is shown at a well site, in some embodiments, the reservoir simulator 160 or other components in FIG. 1 may be remote from a well site. In some embodiments, the reservoir simulator 160 is implemented as part of a software platform for the well control system 126. The software platform may obtain data acquired by a control system as inputs, which may include multiple data types from multiple sources. The software platform may aggregate the data from these systems in real time for rapid analysis. In some embodiments, the well control system 126 and the reservoir simulator 160, and/or a user device coupled to one of these systems may include a computer system that is similar to the computer system (e.g., computer 1402) described below with regard to FIG. 14 and the accompanying description.

In some embodiments, the reservoir simulator 160 may include software configured with machine learning capabilities and artificial intelligence (AI) that learn from trends of the one or more parameters tracked by the well control system 126.

In one or more embodiments, the AI and machine learning (ML) capabilities employed by the reservoir simulator may include any suitable algorithms and processes for predicting well behavior using historical data as input. For example, the ML models or algorithms may include supervised algorithms, unsupervised algorithms, deep learning algorithms that use artificial neural networks (ANN), etc. More specifically, supervised ML models include classification, regression models, etc. Unsupervised ML models include, for example, clustering models. Deep-learning algorithms are a part of ML algorithms based on artificial neural networks with representation learning. For example, the deep-learning algorithm may run data through multiple layers of neural network algorithms, each of which passes a simplified representation of the data to the next layer. With respect to neural networks, for example, a neural network may include one or more hidden layers, where a hidden layer includes one or more neurons. A neuron may be a modelling node or object that is loosely patterned on a neuron of the human brain. In particular, a neuron may combine data inputs with a set of coefficients, i.e., a set of network weights and biases for adjusting the data inputs. These network weights and biases may amplify or reduce the value of a particular data input, thereby assigning an amount of significance to various data inputs for a task being modeled. Through machine learning, a neural network may determine which data inputs should receive greater priority in determining one or more specified outputs of the neural network. Likewise, these weighted data inputs may be summed such that this sum is communicated through an activation function of a neuron to other hidden layers within the neural network. As such, the activation function may determine whether, and to what extent, an output of a neuron progresses to other neurons where the output may be weighted again for use as an input to the next hidden layer.

In some embodiments, a machine-learning model may include an encoder model that transforms input data to a latent representation vector. The machine-learning model may further amalgamate the latent representation vector with a vector representation of a particular parameterization to produced combined data, e.g., using in a latent space domain. Likewise, the machine-learning model may also include a decoder model that transforms the combined vector into the corresponding output data according to the parameterization.

In some embodiments, the machine-learning model is a variational autoencoder. For example, variational autoencoders may compress input information into a constrained multivariate latent distribution through encoding in order to reconstruct the information during a decoding process. Thus, variational autoencoders may be used in unsupervised, semi-supervised, and/or supervised machine-learning algorithms. More specifically, variational autoencoders may perform a dimensionality reduction that reduces the number of features within an input dataset (such as an input gather). This dimensionality reduction may be performed by selection (e.g., only some existing features are preserved) or by extraction (e.g., a reduced number of new features are produced from preexisting features). Thus, an encoder process may compress the input data (i.e., from an initial space to an encoded space or latent space), while a decoder process may decompress the compressed data. This compression may be lossy, such that a portion of the original information in the input dataset cannot be recovered during the decoding process.

In some embodiments, various types of machine learning algorithms may be used to train the model that is used to predict gas flow behavior in new wells, such as a backpropagation algorithm. In a backpropagation algorithm, gradients are computed for each hidden layer of a neural network in reverse from the layer closest to the output layer proceeding to the layer closest to the input layer. As such, a gradient may be calculated using the transpose of the weights of a respective hidden layer based on an error function (also called a "loss function.") The error function may be based on various criteria, such as mean squared error function, a similarity function, etc., where the error function may be used as a feedback mechanism for tuning weights in the electronic model.

A monitoring sub such as sensor 26 may be included in ESP 14 as an optional element. In the example embodiment of FIG. 1, sensor 26 is located at a lower end of motor 16. Sensor 26 can gather and provide data relating to operations of ESP 14 and conditions within the wellbore. As an example, sensor 26 can monitor and report the intake pressure and temperature and the discharge pressure and temperature of the pump 18. The sensor 26 may be located at a downhole location. In this manner the intake pressure and temperature may measure and record a downhole pressure and a downhole temperature. The sensor may monitor and report the lubricating oil and winding temperatures of the motor 16, the assembly vibration of ESP 14 in multiple axes, and any leakage current of motor 16 of ESP 14. The sensor 26 may be electrically connected to a control system and the downhole pressure and the downhole temperature may be recorded using the control system.

In accordance with one or more embodiments the system may include a control system configured to send a measure downhole pressure command to measure a downhole pressure to a monitoring sub (e.g., sensor 26) coupled to the ESP. The monitoring sub may be configured to obtain a measured downhole pressure upon receipt of the measure downhole pressure command; and a computer processor may be configured to compare the measured downhole pressure with a predetermined downhole pressure criterion.

In accordance with one or more embodiments a computer processor such as one included in a control system may send to the monitoring sub (e.g., sensor 26) coupled to the ESP a command to measure downhole pressure (e.g., a measure downhole pressure command). Upon receipt of the measure downhole pressure command, the monitoring sub may subsequently obtain a measured downhole pressure. The computer processor may compare the measured downhole pressure with a predetermined downhole pressure criterion. The control system may perform an action as a result of the downhole pressure comparing.

In accordance with one or more embodiments the system may include a control system configured to send a measure gas flowrate command to measure a gas flowrate to a flowrate instrument (e.g., flow rate sensor 140) coupled to the wellhead. The flowrate instrument may be configured to obtain a measured gas flowrate at the wellhead upon receipt of the measure gas flowrate command and a computer processor may be configured to compare the measured gas flowrate with a predetermined surface flowrate criterion.

The control system may send to a flowrate instrument (e.g., flow rate sensor 140) coupled to the wellhead a command to measure gas flowrate (e.g., a measure gas flowrate command). Upon receipt of the measure gas flowrate command the flowrate instrument may obtain a measured gas flowrate at the wellhead. The computer processor may compare the measured gas flowrate with a predetermined surface flowrate criterion, and then perform an action in response to a result of the gas flowrate comparing.

In accordance with one or more embodiments, the system may include a control system configured to send a measure gas pressure command to measure a gas pressure to a pressure sensor (e.g., surface pressure sensor 136) coupled to the wellhead. The pressure sensor may be configured to obtain a measured gas pressure at the wellhead upon receipt of the measure gas pressure command and a computer processor may be configured to compare the measured gas pressure with a predetermined surface pressure criterion.

The control system may send to a pressure sensor (e.g., surface pressure sensor 136) coupled to the wellhead a command to measure gas pressure (e.g., a measure gas pressure command). Upon receipt of the measure gas pressure command the pressure sensor may obtain a measured gas pressure at the wellhead. The computer processor may compare the measured gas pressure with a predetermined surface pressure criterion and then perform an action in response to a result of the gas pressure comparing.

In accordance with one or more embodiments, the system may include a control system configured to send a measure gas temperature command to measure a gas temperature to a temperature sensor (e.g., surface temperature sensor 138) coupled to the wellhead. The temperature sensor may be configured to obtain a measured gas temperature at the wellhead upon receipt of the measure gas temperature command. and a computer processor may be configured to compare the measured gas temperature with a predetermined surface temperature criterion.

The control system may send to a temperature sensor (e.g., surface temperature sensor 138) coupled to the wellhead a command to measure gas temperature (e.g., a measure gas temperature command). Upon receipt of the measure gas temperature command the temperature sensor may obtain a measured gas temperature at the wellhead. The computer processor may compare the measured gas temperature with a predetermined surface temperature criterion and then perform an action in response to a result of the gas temperature comparing.

In accordance with one or more embodiments, pump 18 is adjacent to intake 24, intake 24 is located between pump 18 and protector 20, protector 20 is located between intake 24 and motor 16, and motor 16 is located further within subterranean well 10 than pump 18. Therefore, from top to bottom the elements are ordered: pump 18, intake 24, protector 20, and motor 16.

Well fluids such as well fluid F (e.g., a well fluid 32) is shown entering wellbore 12 from a formation adjacent to the wellbore through perforations 27. Well fluid F for production flows to opening 29 of intake 24. Well fluid F is pressurized by pump 18 and travels up to the wellhead 28 at surface 30 through a production tubing 34. Production tubing 34 is in fluid communication with ESP 14. The production tubing has an inner bore (e.g., a bore 35) sized to deliver well fluid F from ESP 14 to wellhead 28. ESP 14 is positioned within the wellbore so that motor 16 is located downstream, or uphole, of perforations 27 so that well fluid F flowing through perforations 27 passes the motor 16 before entering intake 24. This helps to cool motor 16 with well fluid F.

FIG. 1 shows ESP 14 is suspended from, and supported by, production tubing 34. Production tubing 34 is an elongated tubular member that extends within subterranean well 10. Production tubing 34 can be formed of carbon steel material, carbon fiber tube, or other types of corrosion resistant alloys or coatings. In other embodiments the ESP 14 may be suspended from cable such as wireline cable. The wireline cable may be extended and retracted by a cable reel or cable winch coupled to a wireline unit.

Well fluid F may contain both gases and liquids as it enters intake 24 and both the gases and liquids can be produced to wellhead 28 through production tubing 34 as a combined production fluid. Pump 18 is operable to provide artificial lift to well fluid F that contains a combined gas and liquid mixture and the production tubing 34 has an inner bore sized to deliver the combined gas and liquid mixture to wellhead 28.

Well fluid F is produced through production tubing 34. Tubing casing annulus 36 is an annular space located between an outer diameter of production tubing 34 and an inner diameter of outer tubular member 22. There is no outlet for well fluid within ESP 14 to travel back into the wellbore, i.e., well fluid F is not produced through the tubing casing annulus 36.

An ESP power cable such as a power cable 38 extends through the wellbore alongside production tubing 34. Power cable 38 can provide the power required to operate motor 16 of ESP 14. Power cable 38 extends to a packer assembly (e.g., a packer 40) and can be connected to packer with a packer penetrator at the top side of packer. Power cable 38 can then extend between packer and motor 16 with a motor lead extension. The motor lead extension can be connected to a packer penetrator at the bottom side of packer. Power cable 38 can be a suitable power cable for powering an ESP 14, known to those with skill in the art.

Inverted shroud (e.g., a shroud 42) is a generally tubular member that has a closed end 44 located between intake 24 and protector 20. The closed end 44 circumscribes electrical submersible pump assembly (e.g., ESP 14) and prevents well fluid F from entering within the shroud at the closed end 44. An opposite open end (e.g., an open end 46) of the shroud is open towards the packer. Fluids flowing through perforations 27 therefore travel in a direction towards wellhead assembly (e.g., wellhead 28, FIG. 1). Due to the presence of the shroud, well fluid F continues upwards past the motor towards the packer. Well fluid F then changes direction and travels away from the wellhead before entering the intake 24 and subsequently being produced through production tubing 34 to the wellhead.

Well fluid F flowing up the wellbore is therefore made to go through a 180° turn towards intake 24. Due to this turn and the interaction and mixing of well fluid F at and below a bottom surface of the packer, any gas pockets keep moving with well fluid F and accumulation of gas under the packer assembly is prevented. If any gases do separate from liquid and begin to gather at the bottom surface of the packer, eddies and current of well fluid F will cause such gases to be carried with well fluid F into intake 24. Therefore, the bottom of the packer remains free of accumulated gas. The liquid and gas components of well fluid F are well mixed, therefore the liquid phase carries the gas pockets into the intake 24 and pump 18 pressurizes and pumps the combined gas and liquid mixture to the surface as in a conventional method.

The packer is spaced apart from the shroud a distance that provides for a mixing of the gases and liquids of well fluid F. Mixing of the combined gas and liquid mixture occurs between the packer and the shroud before the combined gas and liquid mixture enters the shroud. As an example, the open end 46 of the shroud can be spaced from the packer to allow mixing of the gas and liquid in the well fluid mixture. In an alternate example, the open end 46 of the shroud can be spaced a distance from the packer to allow mixing of the gas and liquid well fluids.

Figure 2:
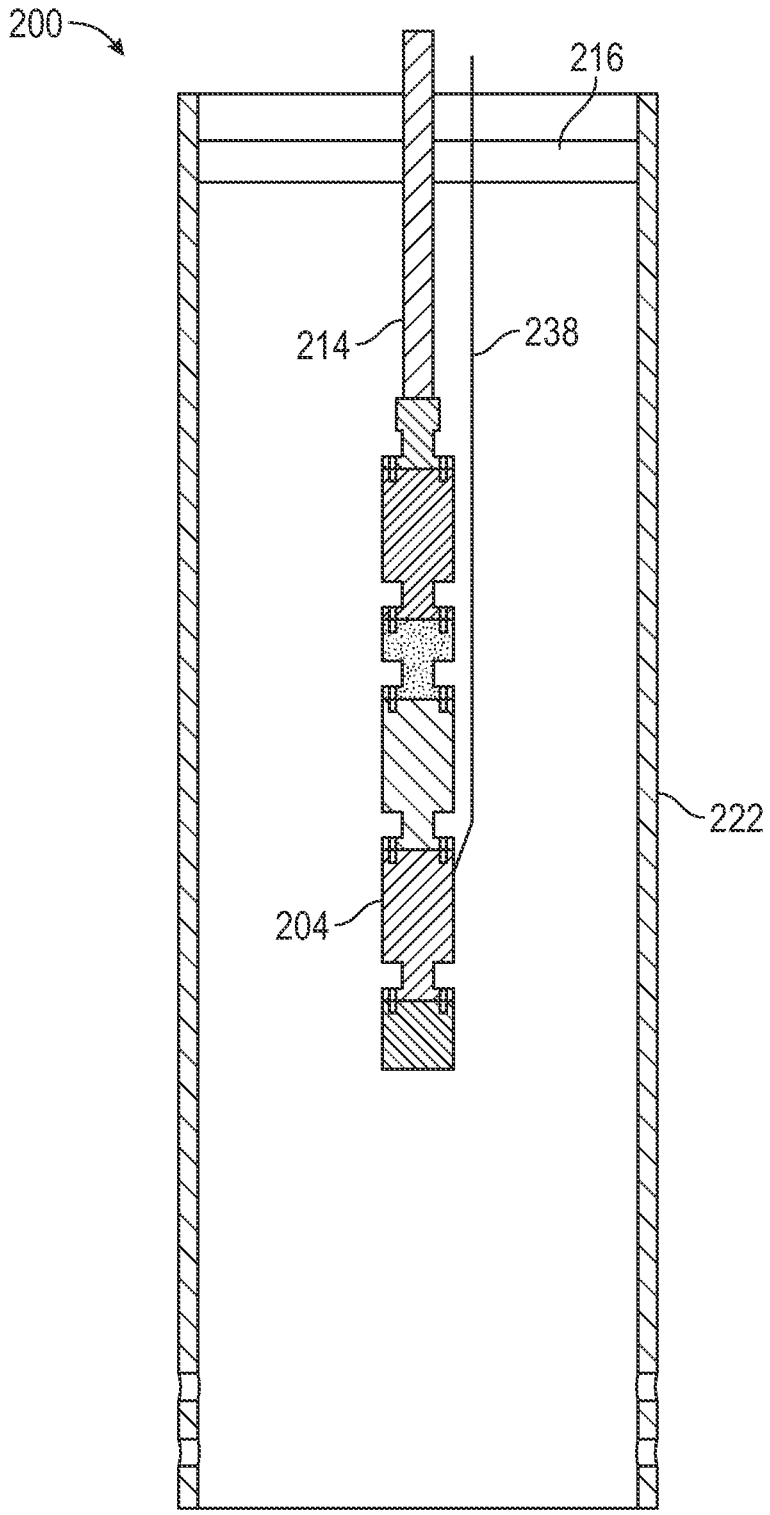
FIG. 2 shows a system for producing hydrocarbons in accordance with one or more embodiments.

FIG. 2 shows that the packer 216 circumscribes production tubing 214 downstream of ESP 200. The packer can be in a contracted position when lowering the packer into the wellbore (e.g., wellbore 12, FIG. 1). In the contracted position, an outer diameter of the packer assembly is spaced apart from the inner diameter of outer tubular member 222. The packer is moveable to an expanded position so that the outer diameter of the packer is in sealing engagement with the inner diameter of outer tubular member 222. A sealing element of the packer can be a traditional packer member known in the art and set in a typical way. An ESP power cable such as a power cable 238 can then extend between the packer and motor 204. The packer is retrievable with ESP 200. As the ESP is pulled out of the well with the production tubing, the packer will remain secured to the ESP. The packer can be designed to contain the pressures of the wellbore so that the packer is a high pressure mechanical barrier.

Figure 3:
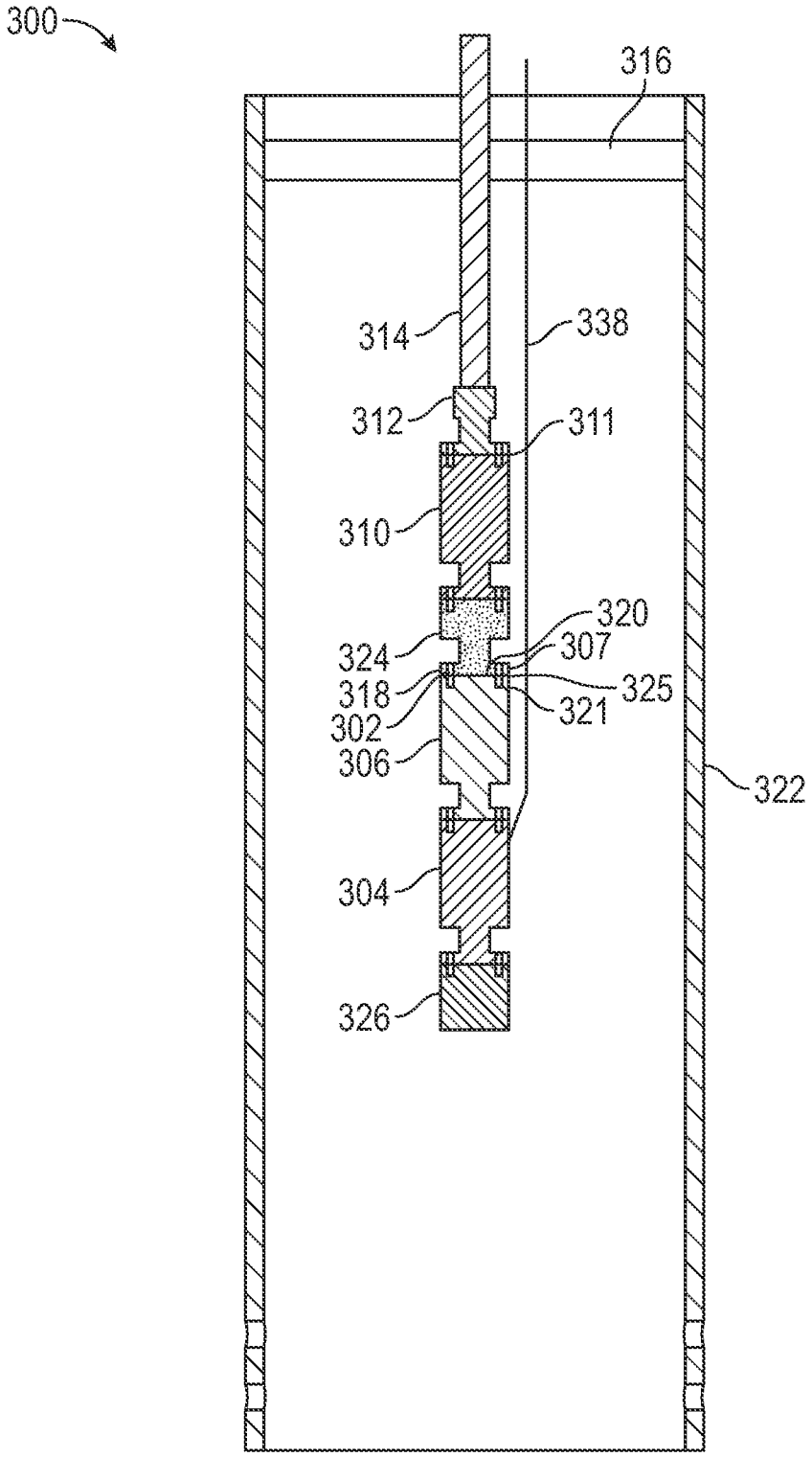
FIG. 3 shows the conventional configuration of a tubing-deployed ESP in accordance with one or more embodiments.

FIG. 3 shows the conventional configuration of a tubing-deployed ESP (e.g., a tubing-deployed ESP 300). An electric submersible pump (ESP) system mainly consists of a pump, which is centrifugal, a protector, power delivery cable, a motor and a monitoring sub or monitoring tool. The pump is used to lift well-fluid to the surface or, if at surface, transfers fluid from one location to another. The motor provides the mechanical power required to drive the pump via a shaft coupling the motor to the pump. An ESP power cable such as a power delivery cable (e.g., a cable 338) provides a means of supplying the motor with the needed electrical power from surface. The protector absorbs the thrust load from the pump, transmits power from the motor to the pump, equalizes pressure, provides/receives additional motor oil as temperature changes, and prevents well-fluid from entering the motor. The pump consists of stages, which are made up of impellers and diffusers. The impeller, which is rotating, adds energy to the fluid to provide head pressure, whereas the diffuser, which is stationary, converts the kinetic energy of fluid from the impeller into head pressure. The pump stages are typically stacked in series to form a multi-stage system that is contained within a pump housing. The sum of head generated by each individual stage is summative; hence, the total head developed by the multi-stage system increases linearly from the first to the last stage. The monitoring sub is installed onto the motor to measure parameters such as pump intake and discharge pressures, motor oil and winding temperature, and vibration. Measured downhole data is communicated to the surface via the power cable.

FIG. 3 show that in typical field installations, the monitoring sub or downhole gauge comprising one or more sensors, (e.g., sensor 326) is coupled to a motor (e.g., motor 304) via a flanged connection. This combined sub-assembly (e.g., the sensor and the motor) is first lowered in a well (e.g., well 10, FIG. 1) before the bottom portion of a protector (e.g., protector 306) is coupled to the top part (uphole end) of the motor via another flanged connection. The three connected components (e.g. the sensor, the motor, and the protector) are lowered in the well. A downhole end (e.g., an intake downhole end 307) of a pump intake (e.g., pump intake 324) has an intake base flange (e.g., an intake base flange 318). The intake base flange is connected to an uphole end of the protector (e.g., a protector top surface 320) at a protector top flange (e.g., a protector top flange 321). The coupling of the protector top flange to the intake base flange forms an intake-protector interface (e.g., an intake-protector interface 325). Coupling the flanges may use fasteners (e.g., fasteners 302) as known in the art.

In FIG. 3, the coupling method is repeated for the installation of a pump (e.g., a pump 310) and a discharge head or discharge sub (e.g., discharge 312). The discharge is coupled to a pump outlet (e.g., pump outlet 311). The production tubing (e.g., pipe element 314) is typically threaded into the discharge and entire downhole assembly is lowered into the well in step-wise manner as additional production tubing is connected by field personnel on the rig floor. Once the entire downhole assembly reaches the desired setting depth, a packer assembly (e.g., a packer 316) is set to contact the inner walls of the casing (e.g., outer tubular member 322), thereby providing the required isolation in the well prior to commencing production.

Figure 4:
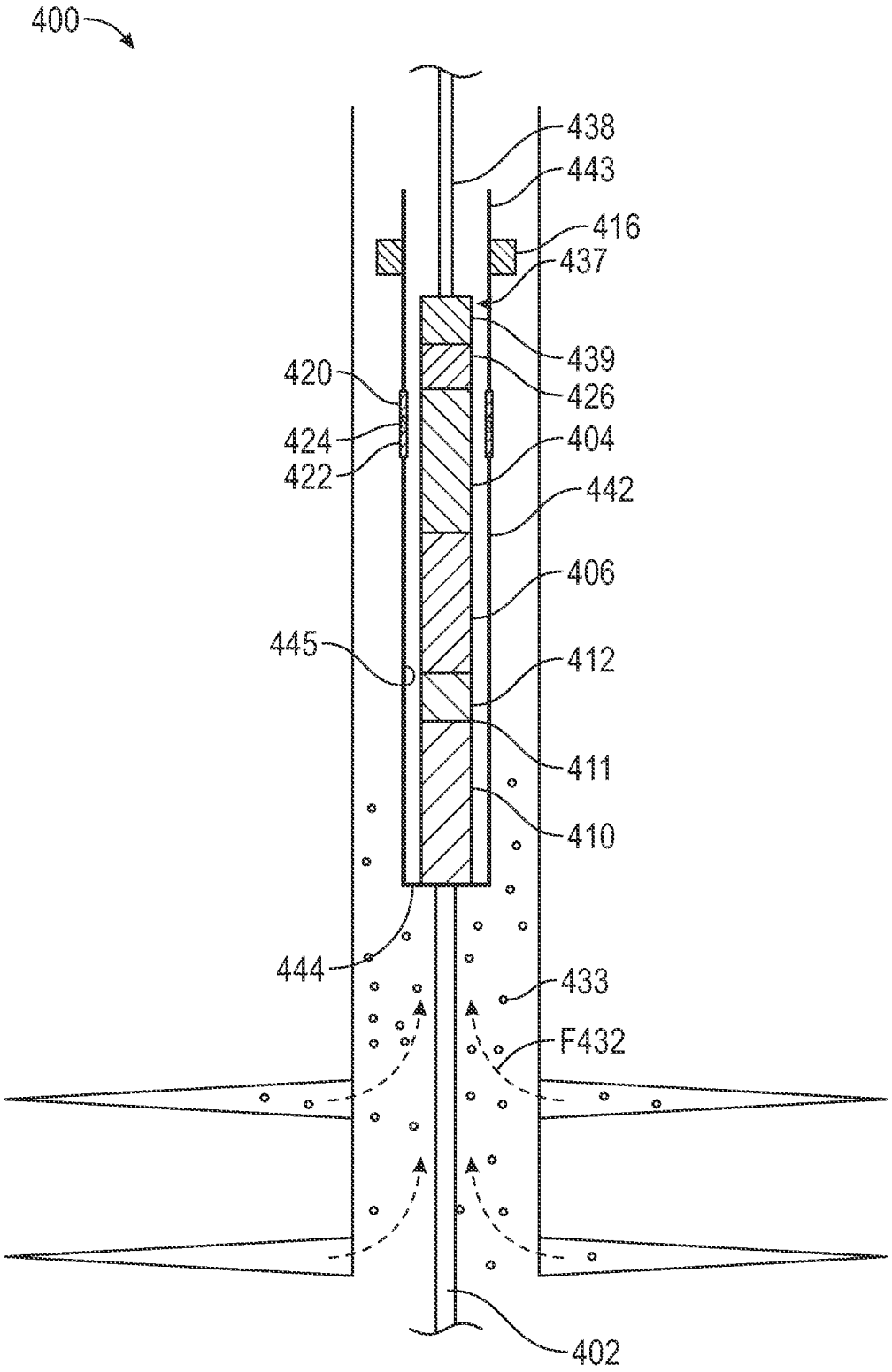
FIG. 4 shows the use of a cable-deployed ESP with a natural-drive natural gas well in accordance with one or more embodiments.

FIG. 4 shows the use of a cable-deployed ESP with a natural-drive natural gas well. Efficient delivery of gas flow F (e.g., a well fluid 432) to surface from wells by natural drive requires producing the gas at pressures above the dew point. When gas pressures in a well fall below the dew point, liquid condensation occurs forming droplets (e.g., liquid condensation droplets 433). Initially, the gas is able to carry these liquid droplets to the surface. However, as production conditions continue to fall further below the dew point and liquid droplets coalesce, the gas stream is not able to carry these droplets to surface. The liquid phase accumulates downhole and as such the liquid chokes back the gas resulting in a decrease in gas flow rate to surface. This phenomenon is called liquid loading. In extreme cases, the amount of liquid accumulation or loading downhole is so severe that no gas is produced to surface.

In addition to the ESP for artificial lift, other solutions are available that can help remedy the above situation, such as plunger lift or rod pump. However, these systems are limited to low gas production rates, and low deviations, to mention but a few, and as such are not suitable for producing higher gas rates. In high-production gas wells, one intervention method to remedy the liquid loading problem is to use coiled tubing (CT) nitrogen. With this method, nitrogen is injected into the liquid loaded gas well via CT to lighten the liquid/condensate column downhole so the gas pressure can overcome the lightened liquid column, and bring the liquid to surface so continuous gas production may resume. Gas production continues until the next liquid loading condition occurs, and the CT nitrogen job is repeated. Lack of availability of a CT nitrogen unit is one challenge experienced by an operator. The long wait times to remedy the liquid loading problem increases locked potential or deferred production from the gas well. Another limitation of CT nitrogen units is they require use of high-pressure equipment at the well site. Handling such pressures at the surface introduces a Health, Safety, and Environmental (HSE) risk to personnel at the surface and the operation as a whole. Furthermore, costs related to mobilizing CT nitrogen units, as well as recurring costs associated with them are quite high due to frequent occurrence of liquid loading. These combined costs increase the field operating cost of an asset and therefore significantly affect the overall economic bottom-line of the operator.

Cable-deployed ESP systems (CDESPs) (e.g., a CDESP 400) are common in oil well production operations. In this system, an ESP power cable (e.g., a cable 438) is attached to an ultra high-speed permanent magnet (UHS PM) motor (e.g., a motor 404) via a cable adapter (e.g., a cable adapter 439), coupled to a monitoring sub (e.g., sensor 426) followed by a protector (e.g., a protector 406) and pump section (e.g., a pump 410) at the bottom.

The standard operating rotational speed of the pumping section is typically up to 3000 revolutions per minute (RPM) or 3500 RPM. High speeds up to 6000 RPM are available. Ultra high-speed (UHS) pumps have been installed. UHS pumps have a rotational speed of up to 10000 RPM to 12000 RPM. The UHS pumps can also be slim pumps with housing outer diameters as small as 2.17 to 3.19-inch, compared to 3.38-inch diameters and above for conventional downhole ESPs. For example, a 3.19-inch housing diameter UHS pump can operate at 11500 RPM and is able to produce about 5200 BPD. The applications highlighted above were for pure liquids as the operating fluid. UHS pumps that can handle higher gas content liquids, upwards of up to 90% intake gas-volume fraction (GVF) are being developed. Intake GVF is the ratio of gas volume rate to the total volume flow rate of gas and liquid at a given intake pressure and temperature.

In accordance with one or more embodiments, the pump section (e.g., the pump 410) may comprise an ultra high-speed, high gas-volume fraction pump (UHS HGVFP.) The disclosed system and method may be applied using any suitable pump, and also may be used to unload kill fluid or brine from oil wells using any suitable pump type. The overall objective is to enable the operator to optimize the field asset. The current disclosure describes a system and a method to unload liquid from a gas well using a cable-deployed ultra high-speed, high gas-volume fraction pump (CD UHS HGVFP) via the production tubing.

FIG. 4 shows the schematic of the CD UHS HGVFP system (e.g., the system). The cable adapter provides the interface between the cable and the motor. The cable, in addition to providing the electric power connection serves as the conveyance mechanism to run-in or pull-out the system from the well. A retrievable swell packer (e.g., a packer 416) is used for isolation and expands when in contact with liquid. The retrievable swell packer can be a traditional swell packer member known in the art and set in a typical way. Such packers can be easily retrieved to surface by exerting a pull force. For example, the packer release pull force may be provided by the cable 438. In accordance with one or more embodiments a separate cable or other retrieval means such as tubing or sucker rod may be used to exert the pull force to release the packer. A first cable (e.g., an ESP power cable such as the cable 438) may be used to provide the electric power to the system, a second cable may be used to convey the system, and a third cable may be used to retrieve the packer. FIG. 4 shows that the cable 438 is used as the ESP power cable, the system conveyance cable, and the packer release cable.

A bypass-sub (e.g., bypass sub 420) has flow ports (e.g., a flow port 422) for fluid access, and flappers (e.g., a flapper 424) to restrict fluid access. The flapper 424 comprises a valve configured to close the flow port until a set of predetermined conditions are met. For example, the flapper may open when a minimum gas pressure opens the flapper. The bypass sub (e.g., bypass sub 420) may have more than one flow port and more than one valve (e.g., flapper 424). The entire system is placed in a shroud such as an inverted shroud (e.g., a shroud 442), which is connected to the base of the pumping section (e.g., a pumping base 444). The packer 416 is coupled to an outer surface of the shroud (e.g., outer surface 443) of the shroud 442. The shroud 442 also has a shroud inner surface (e.g., a shroud bore 445).

FIG. 4 shows that the pump, protector, and motor are all configured for ultra high-speed operation. The motor is of the permanent magnet (PM) design, which can be up to one-third the length of conventional motors due to the higher power density of PM motors. The pump is capable of handling fluid with high GVF up to 90%+ at its intake. The pumped fluid flows into a shroud-pump annulus (e.g., a shroud annulus 437) via a discharge head or discharge sub (e.g., a discharge 412). The discharge is coupled to a pump outlet (e.g., pump outlet 411). The shroud-pump annulus is the space between the shroud bore 445 and the outside diameters of the components of the ESP that are disposed within the shroud, i.e., the outside diameters of the motor 404, the protector 406, the pump 410, the discharge 412, etc.

FIG. 4 shows that a tail pipe (e.g., a tail pipe 402) is threaded into the base of the pump (e.g., a pumping base 444). The function of the tail pipe is to enable access to liquid in horizontal or highly-deviated gas wells. For vertical or less-deviated wells and depending on the specific well conditions, use of the tail pipe may not be necessary. For example, if the pumping section can be submerged in the well fluid then the tail pipe is not necessary. For maximum access to the liquid, a tail pipe may be used.

Figure 5:
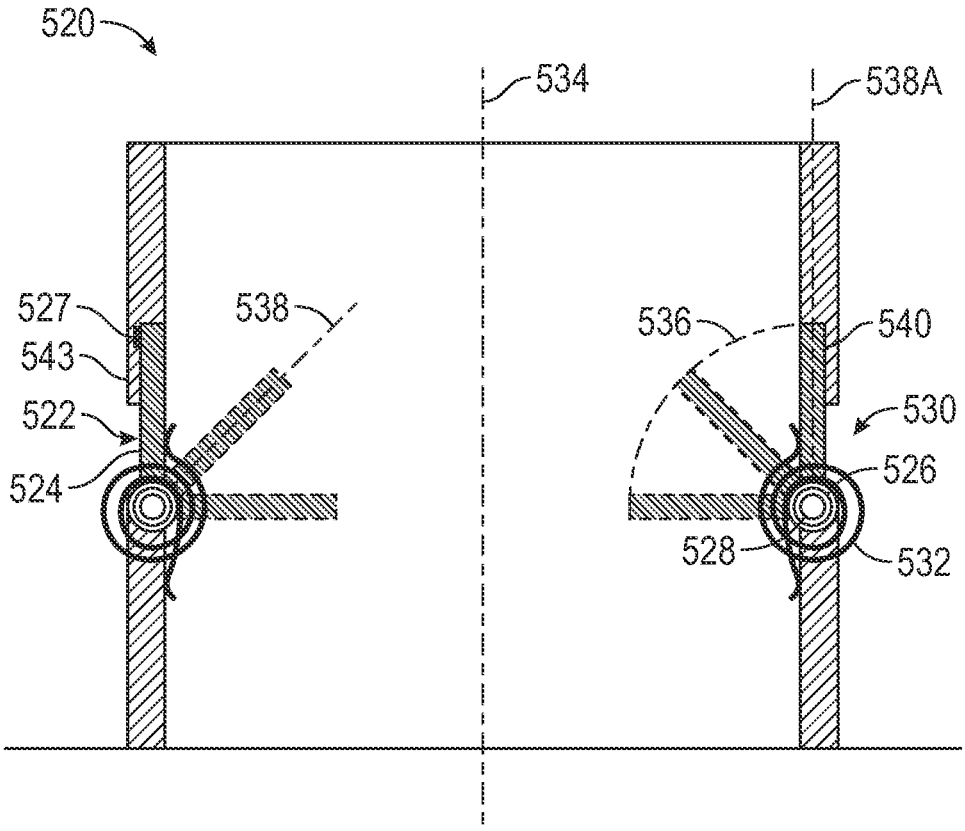
FIG. 5 shows some of the main components of the bypass sub in accordance with one or more embodiments.

FIG. 5 shows some of the main components of the bypass sub (e.g., a bypass sub 520). One or more flow ports (e.g., a flow port 522) are located on the outside surface of the bypass sub (e.g., a bypass sub outer surface 543) and the flow ports are covered by one or more flappers (e.g., a flapper 524). The flappers may comprise a hinge point such as a flapper pivot (e.g., flapper pivot 526) and a longitudinal axis along a flapper length (e.g., a flapper longitudinal axis 538). The flappers rotate or pivot from a first position to a second position and/or any position between the first position and the second position. For example, a first position may be a closed position and a second position may be an open position.

The flappers rotate or pivot about a spring-loaded hinge system (e.g., pivot system 530) comprising a pivot spring (e.g., a pivot spring 532) and a flapper hinge (e.g., a hinge 528). The hinge 528 cooperates with the flapper pivot 526 to pivot the flapper 524 along a path (e.g., a path 536) such as an arc with a centerpoint coincident with the flapper hinge. The pivot spring may provide a rotational or rotary force, i.e., a torque to move the flapper along the path. The pivot system may be configured to hold the flappers in a default position (e.g., a flapper default position 540). For example, a flapper default position may be the first position such as a position in which a flapper longitudinal axis vertical position 538A is substantially aligned with an axis of the bypass (e.g., a bypass axis 534).

In accordance with one or more embodiments the pivot system may include a means of rotatably coupling the flapper 524 to the bypass sub 520. The pivot system may include active actuation of the flapper. Active actuation may include electrically-operated, hydraulically-operated, and/or mechanically-operated components. Components of the pivot system may include fasteners such as studs, nuts, screws, bolts, and pins engaging the flapper, e.g., through a hole or slot in the flapper 524 and/or hinge 528. The coupling may include one or more rotatable bearings such as a ball bearing, cylindrical roller bearing, spherical roller bearing, tapered roller bearing, and/or journal bearing on one or both of the flapper, the hinge, and/or the bypass sub. The coupling may include a mating shaft or axle, pin, stud or rod on the other of the bypass sub, hinge, and/or flapper.

In accordance with one or more embodiments the means for providing the spring force may include one or more springs, metallic springs, gas-charged springs, motors, linear actuators, electro-magnets, solenoids, hydraulic cylinders, gears, or jack screws and/or latches, locks, or braking mechanisms. Electrically-operated means of active actuation for providing the spring force may be powered by a battery or batteries, or by an external power source, electrically coupled to the electrically-operated means.

Active actuation for moving the flapper may be initiated by a deploy command to move the flapper sent from a control system and obtained by a flapper control module electrically coupled to the flapper. The flapper control module may be configured to move the flapper upon receipt of a command. The flapper control module may be electrically coupled to the control system using the cable (e.g., cable 438, FIG. 4). Those skilled in the art will readily appreciate that the means for coupling and the means for moving the various elements combining fasteners, bearings, and actuators may be configured without departing from the scope of this disclosure. The means of providing the spring force may include one or more of, and in any combination in compression or in tension, a coil spring, a constant tension spring, a torsion spring, a gas-charged cylinder spring. The flapper spring (e.g., pivot spring 532) may be a coil spring.

FIG. 5 shows the flapper default position as a substantially vertical position (e.g., the flapper longitudinal axis vertical position 538A). As shown in FIG. 5, the flapper blocks the flow port. Therefore, in FIG. 5, the example default position or first position of the flapper of the bypass sub can be said to be "normally closed." The flappers rest on the wedge/stop (e.g., a flapper stop 527), which is recessed into the body of the bypass sub. The flappers rest on the flapper stop 527 due to the rotary force or torque from the spring. In this manner the selection of the spring stiffness corresponds with a pressure required to overcome the spring rotary force to pivot the flapper away from the flow port, i.e., to open the flow port. Selection of the spring stiffness is a common engineering design exercise, which depends on the force and hence pressure required to cause the flapper to tilt open. Such designs may be selected based on the downhole gas pressures to which the equipment will be exposed after the liquid has been lifted out of the well. In this manner the spring may be sized for a method of flowing gases to the wellhead assembly. The spring will be exposed to well fluids, therefore the spring may be made of a material that is robust for the downhole environment (e.g., corrosion-resistant, abrasion-resistant, erosion-resistant, etc.), to enhance reliability of the spring.

The flapper 524 comprises a valve configured to close the flow port. The bypass sub (e.g., bypass sub 520) may have more than one flow port and more than one valve (e.g., flapper 524). The size of each of a plurality of flow ports may vary and the spring stiffness may vary for each flapper at each of the plurality of flow ports. In this manner the ports, valves, and springs may be configured for opening in a predetermined sequence. For example, as the gas pressure begins to increase to a first gas pressure, a first valve at a first port may overcome a first spring stiffness to open the first valve at the first gas pressure. The first valve and the first port may be configured to flow a first gas flowrate. As the pressure increases beyond the first gas pressure to a second gas pressure, a second valve at a second port may overcome a second spring stiffness to open at the second gas pressure. The second valve and the second port may be configured to flow a second gas flowrate. In like manner, valves, springs, and ports for additional valves may flow at various predetermined rates.

Figure 6:
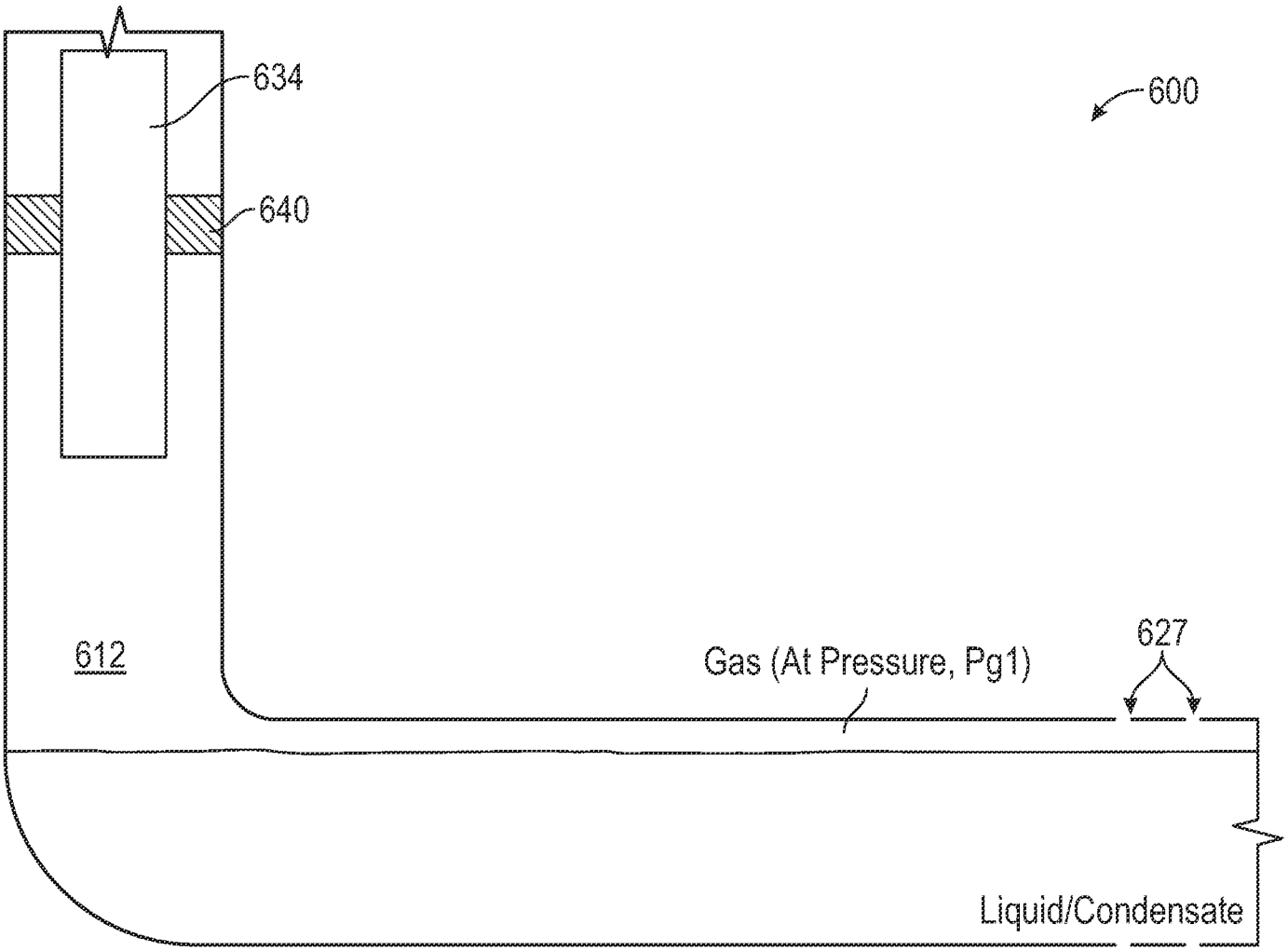
FIG. 6 shows a layout of a loaded horizontal well in accordance with one or more embodiments.

FIG. 6 shows a layout of a loaded horizontal well (e.g., a liquid-loaded well 600). The production packer (e.g., the packer 640) provides isolation from the well below (e.g., wellbore 612) and in normal operation, high pressure gas flows from the perforations (e.g., perforations 627) up the production tubing (e.g., production tubing 634) to surface. FIG. 6 shows that liquid loading has already occurred with the liquid level relatively high in the horizontal section of the well. As a result, the gas pressure (at Pg1) is low such that it is unable to flow naturally to surface via the production tubing.

Figure 7:
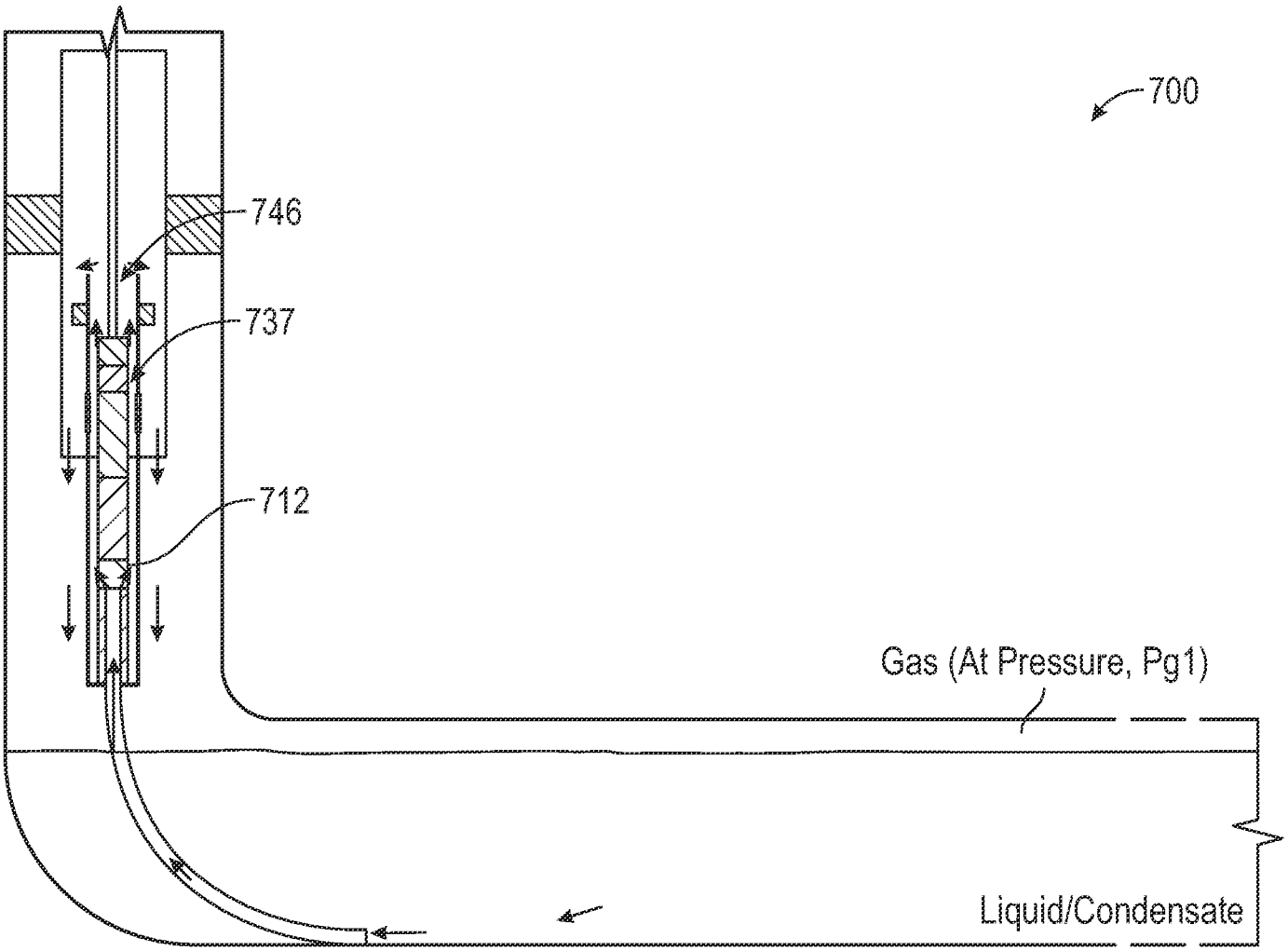
FIG. 7 shows a flapper-closed state in accordance with one or more embodiments.

FIG. 7 shows a flapper-closed state (e.g., a flapper-closed state 700) in which liquids flow out of the discharge head or discharge sub (e.g., discharge 712) into the shroud annulus (e.g., shroud annulus 737). FIG. 7 shows the CD UHS HGVFP is now installed through the production tubing and is at the downhole setting depth with its power off (i.e., the ESP is not activated). Installation of the pumping system into the well may be done using a minimum height lubricator of, for example, about 60 ft. The tailpipe is submerged in the liquid downhole. Due to the residual gas static pressure, Pg1, liquid flows through the tailpipe, into the pump and out through the discharge and fills up the shroud-pump annulus (e.g., a shroud annulus 737). Depending on the magnitude of the residual gas static pressure, the fluid spills over the top end of the shroud (e.g., an open end 746) and back down through the production tubing into the well below.

Figure 8:
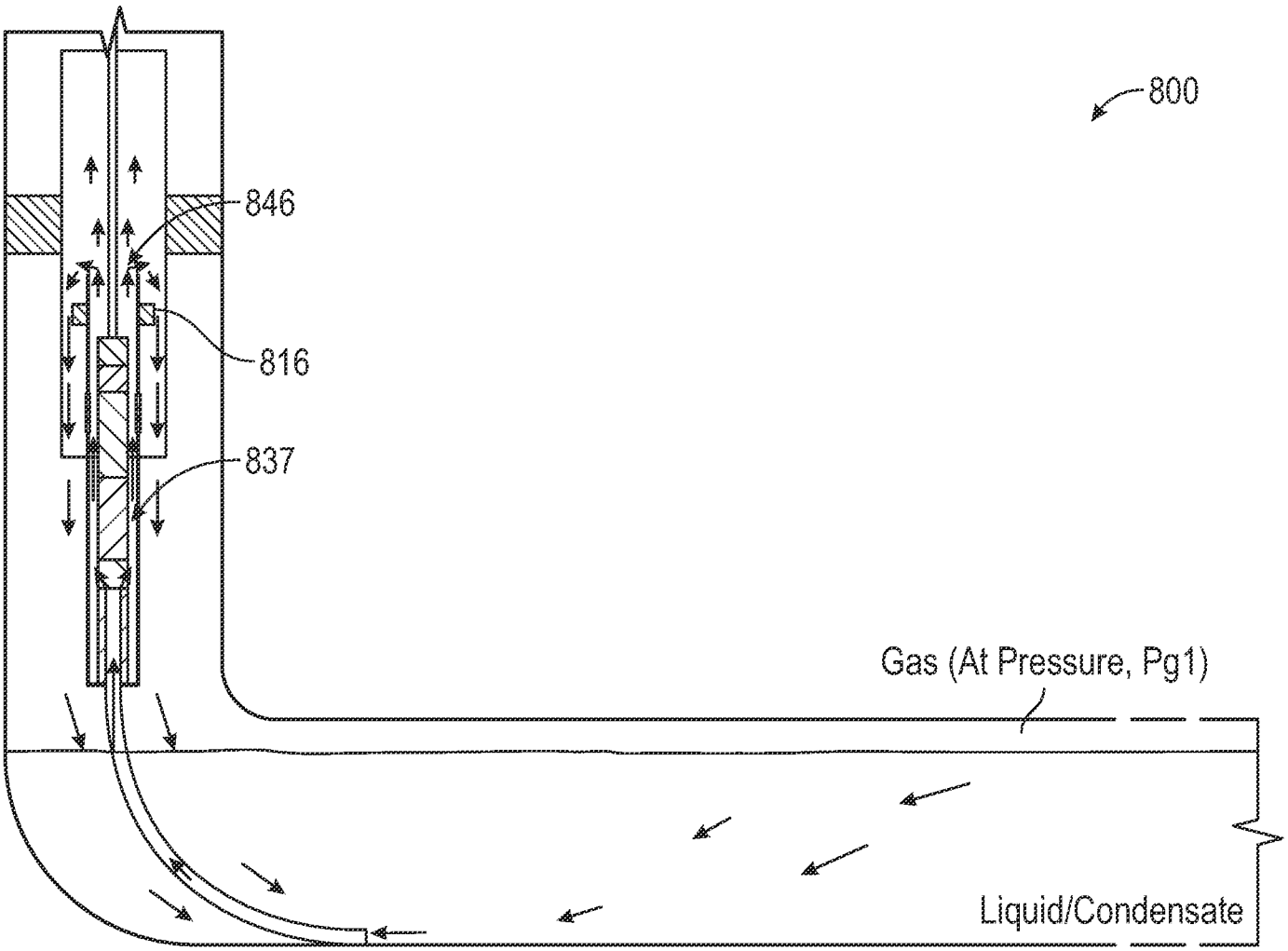
FIG. 8 shows a recirculation state in accordance with one or more embodiments.

FIG. 8 shows a recirculation state (e.g., a recirculation state 800) flapper-closed state in which the pump is activated (turned on) and liquids flow out of a shroud open end at the top of the shroud (e.g., an open end 846). The liquid also provides some cooling effect to the motor as it flows past the motor. The shroud configuration directs the liquids to immerse the packer (e.g., a packer 816). The pumping system recirculates the liquid continuously. The flappers in the bypass sub still remain in their normally closed position, because the fluid pressure in the shroud-tubing annulus (e.g., a shroud annulus 837) is significantly below the value required to overcome the closing torque applied on the flappers by the spring mechanism. With the liquids constantly flowing past the retrievable swell packer and making contact with the packer, thereby partially or completely immersing the packer in liquid, the exposure to the liquids thereby causes the packer to be activated, i.e., the packer starts to expand.

Figure 9:
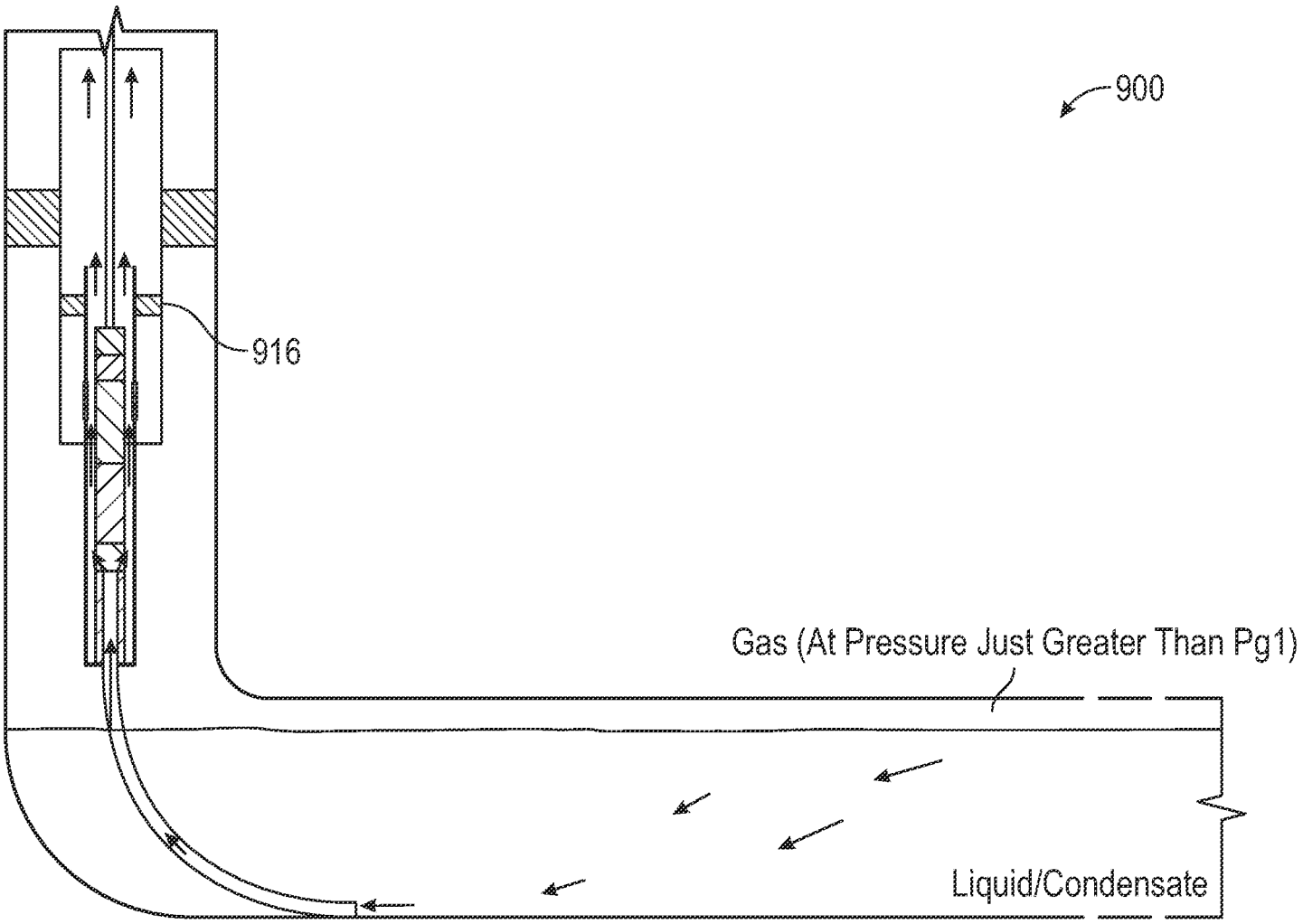
FIG. 9 shows a flapper-closed state in accordance with one or more embodiments.

FIG. 9 shows a flapper-closed state in which the pump is activated and liquids flow up the tubing (e.g., a tubing flow state 900). The retrievable swell packer, having had liquid flowing past it to activate the packer, is shown as having been fully activated by exposure to the liquids. The retrievable swell packer (e.g., a packer 916) is now fully expanded, and has made contact with the inside wall of the production tubing to form an annular seal between the outer surface of the shroud and the production tubing bore. All the liquid is now produced up the production tubing to surface. As this continues, the gas static pressure starts to increase just above the initial value at Pg1.

Figure 10:
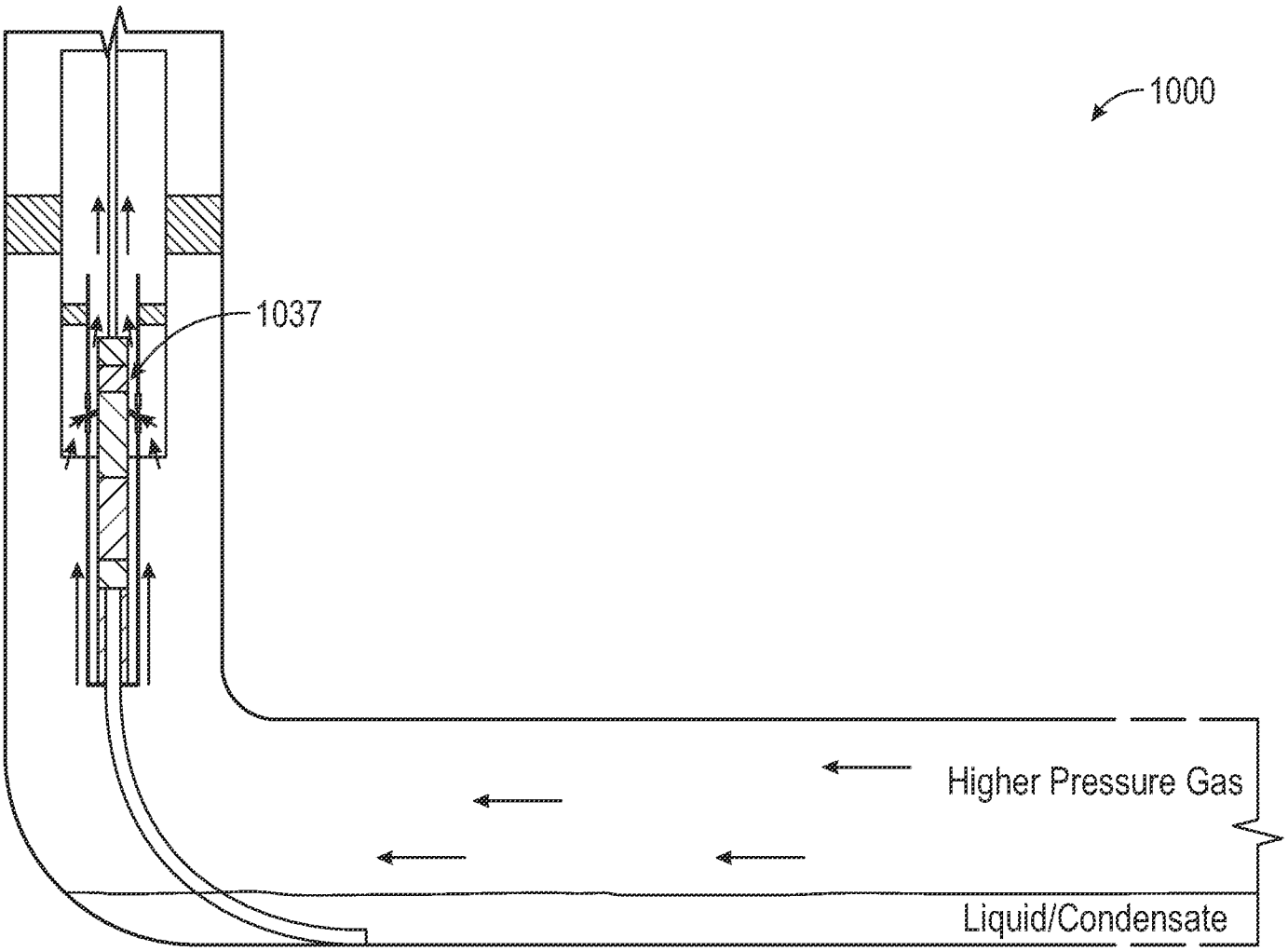
FIG. 10 shows a flapper-open state in accordance with one or more embodiments.

FIG. 10 shows a flapper-open state in which gases flow through the flapper (e.g., a flapper flow 1000) having unloaded a given amount of liquid, the back pressure on the perforations is relieved and the gas static pressure increases significantly. Once the downhole gas static pressure reaches a certain minimum value, Pg2, say, the resisting torque from the spring-mechanism is overcome. This causes the flappers to tilt away from the ledge, opening the flow ports and causing the gas to flow into the shroud-pump annulus (e.g., a shroud annulus 1037). The gas will preferentially flow up the shroud-pump annulus due to gravity and also because there is less resistance to fluid uphole than downhole. This causes the gas to bypass the pump and flow unrestricted to surface. Flow of gas up the shroud-pump annulus may be detected by higher pressure readings from the monitoring sub (e.g., sensor 426, FIG. 4). Additional confirmation of gas flow is physical measurement, using sensors such as those in surface sensing system 134, FIG. 1. For example, confirmation of gas flow may be determined by measurement of flow rate at surface (using, e.g., flow rate sensor 140, FIG. 1) or higher wellhead pressures and temperatures (using, e.g., surface pressure sensor 136 and/or surface temperature sensor 138 shown in FIG. 1). Once gas flow rate up the production tubing is detected, the pumping system may be powered off, e.g., the ESP may be deactivated. With the pumping system powered off, the ESP may be retrieved back to surface. This is accomplished by pulling on the cable so that the retrievable swell packer disengages or breaks contact with the inside diameter of the production tubing.

Figure 11:
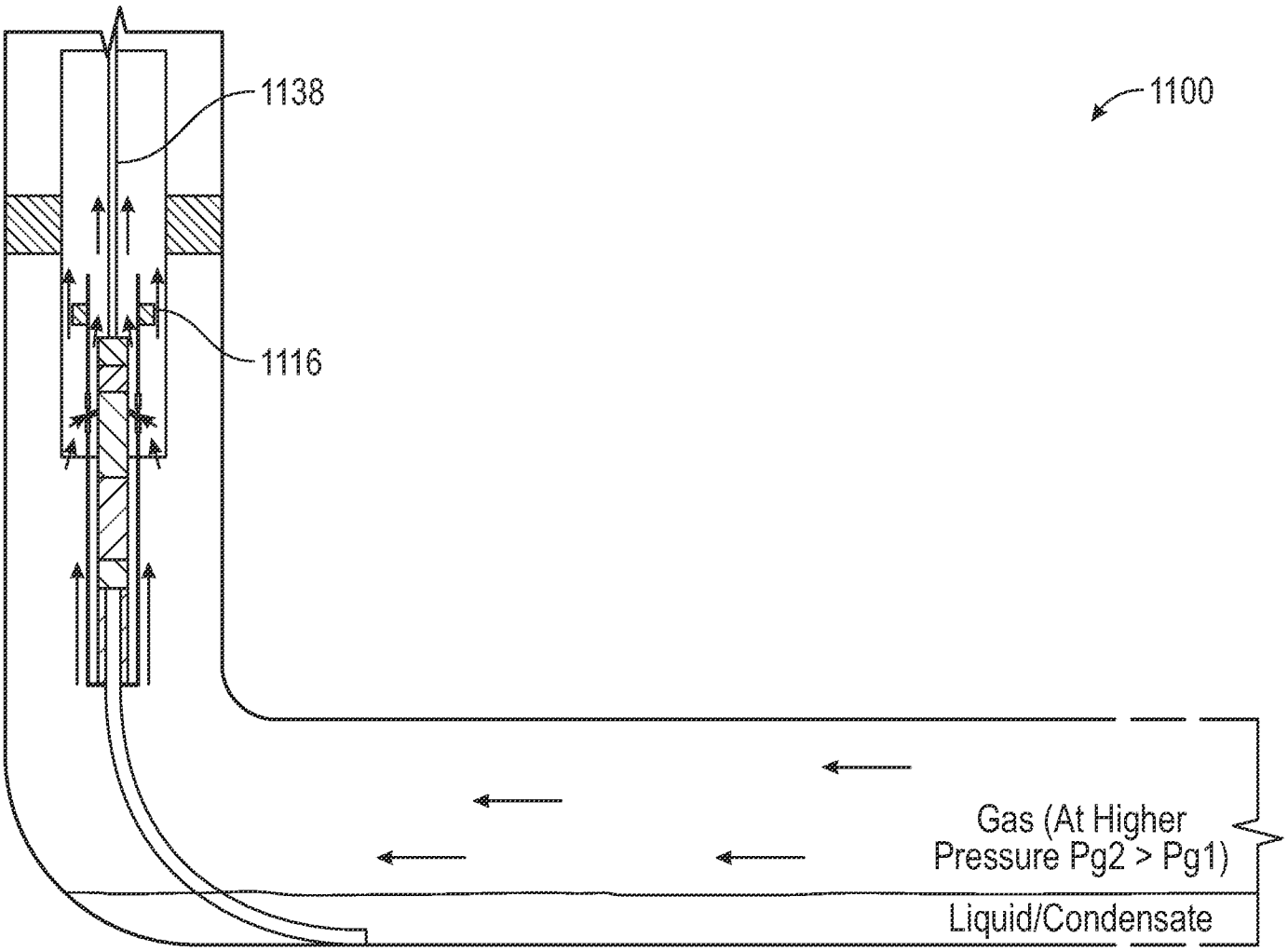
FIG. 11 shows retrieval of the pumping system in accordance with one or more embodiments.

FIG. 11 shows retrieval of the pumping system (e.g., a pumping system retrieval 1100). When this occurs, the pumping system can be lifted out of the well by spooling back the cable (e.g., cable 1138) at surface. At the same time, the retrievable packer, i.e., the swellable packer (e.g., packer 1116) disengages from the production tubing and thus there is reduced restriction on the gas flow. The gas flows around the swell packer resulting in more gas volume production to surface 30, FIG. 1.

Figure 12:
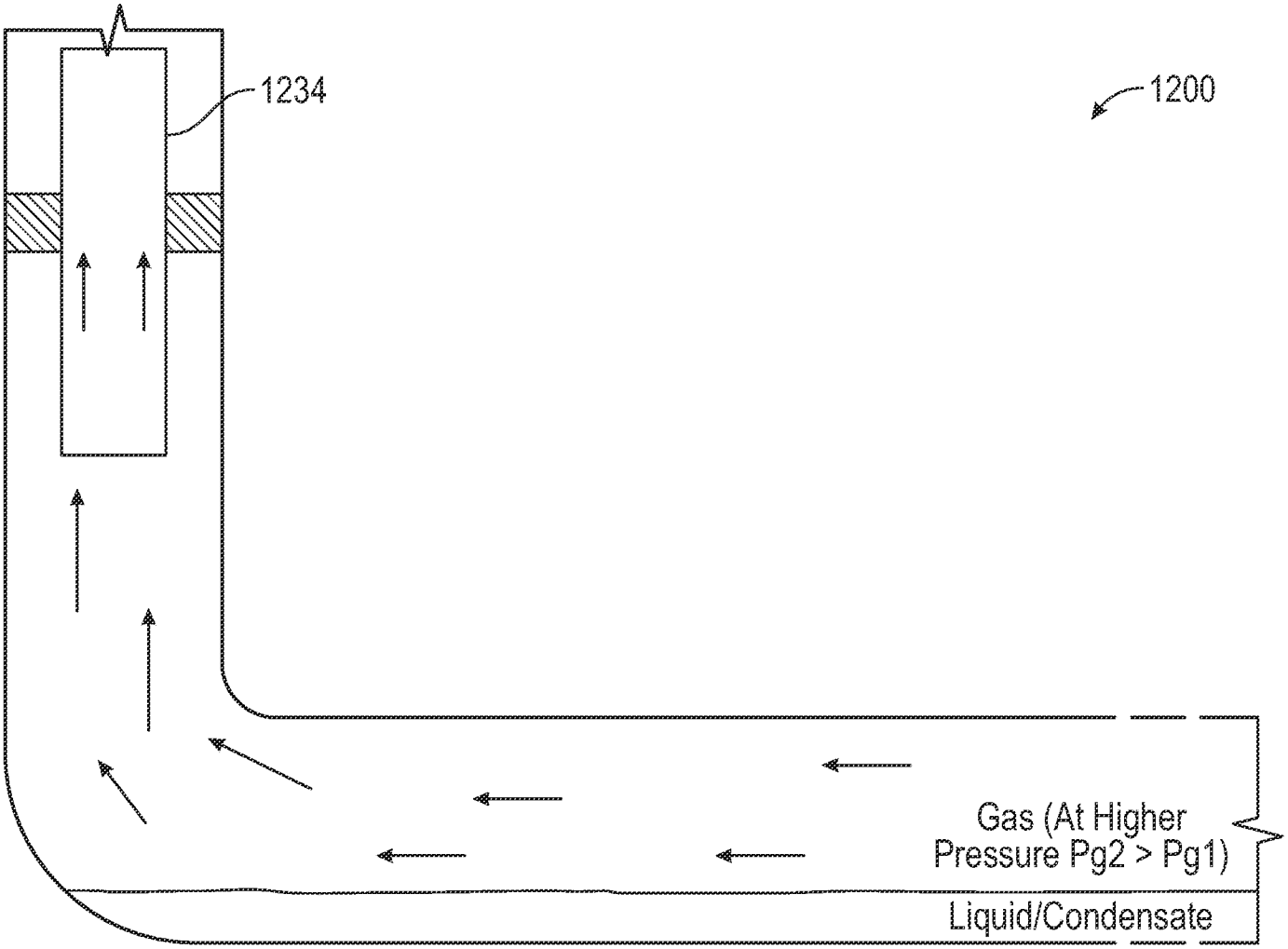
FIG. 12 shows a layout of an unloaded horizontal well in accordance with one or more embodiments.

FIG. 12 shows a layout of an unloaded horizontal well (e.g., an unloaded well 1200). In FIG. 12 the pumping system has been fully retrieved to surface and the high pressure gas flows naturally and unrestricted up the production tubing (e.g., production tubing 1234) to surface, thereby mitigating the liquid loading problem.

The embodiments disclosed herein do not limit in any way the scope of this invention. It is possible that different combinations of the components, systems, and procedures highlighted in this disclosure can be implemented. For example:

Although the system has been described using an ultra high-speed pump, the procedure may be applied using a suitable downhole pump depending on the specific well condition to be unloaded.

The system was disclosed as a temporary intervention method. However, it may be configured to use as a permanent system for gas wells experiencing more frequent loading. In such situations, the system stays downhole and the pump can be switched on and off as required to unload the well.

The system is described with having a tail pipe to access the liquid in a horizontal or highly deviated gas well. The system may be assembled without a tail pipe if deployment is in a vertical or less deviated liquid loaded gas well and depending on the specific well conditions, the pumping section can be submerged in the well fluid prior to unloading the gas well.

Although the system has been described for gas wells, it may be applied to oil wells. For example, in situations where a kill fluid (heavy brine) has been pumped into a well with the well fluid below it. The disclosed system may be installed through the tubing to unload the kill fluid to allow natural flow of the oil below through the bypass section, up the production tube to surface.

Power required to operate the motor and system could be from a fixed, mains supply system, a mobile, generator system, or any permutation and combination of external energy source to operate the system.

Figure 13:
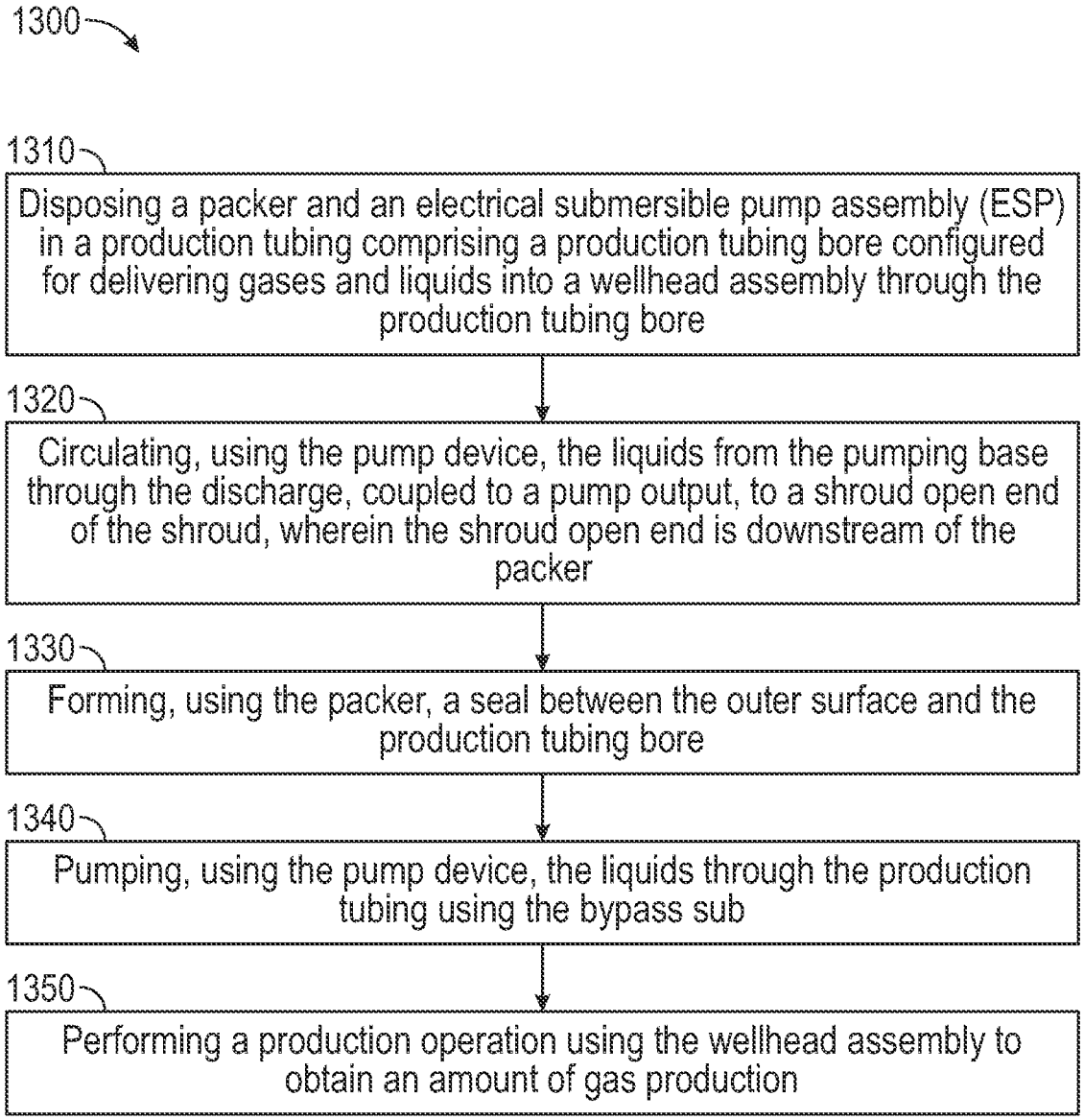
FIG. 13 shows a flowchart in accordance with one or more embodiments.

Turning to FIG. 13, FIG. 13 shows a flowchart (e.g., a method 1300) in accordance with one or more embodiments. Specifically, FIG. 13 is a flowchart of an example method for unloading a liquid-loaded well thereby reviving the well using a through-tubing cable-deployed pump. FIG. 13 describes a general method using a cable-deployed ESP with an inverted shroud and a tail pipe to flow fluids in various pipe components in a wellbore. One or more blocks in FIG. 13 may be performed by one or more components, e.g., as described in FIGS. 1-12. While various blocks in FIG. 13 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively. The method 1300 includes the following steps.

At step 1310, a packer and an electrical submersible pump assembly (ESP) are installed in a production tubing. The production tubing has a bore configured for installation of the ESP. The ESP includes a pump device, a discharge, a shroud, and a bypass sub coupled to the shroud. The shroud has a closed end that is coupled to a pumping base of the pump device. The packer is coupled to an outer surface of the shroud, and the packer is located downstream of the bypass sub. The production tubing is in fluid communication with well fluids containing gases and liquids and the production tubing is configured for delivering the gases and the liquids into a wellhead assembly through the production tubing bore.

At step 1320, the pump is activated. The pump circulates the liquids from the pumping base out a pump outlet and through the pump discharge. The liquids pumped out of the discharge are pumped to a shroud open end of the shroud. The shroud open end is downstream of the packer. The liquids fill the annulus between the inside of the shroud and the outside of the pump components. The liquids fall back downhole thereby immersing the packer in liquid causing the packer to swell.

At step 1330, a seal is formed, using the packer, between the outer surface of the shroud and the bore of the production tubing. The seal is formed as the packer swells up to close the annular space between the inside of the production tubing (production tubing bore) and the outside of the shroud (shroud outer surface.) In this step the valves (e.g., the flappers) are closed.

At step 1340, the pumping device pumps the liquids through the production tubing using the bypass sub. In this manner the liquids are pumped out of the downhole region up to the surface where the liquids are processed.

At step 1350, a production operation, such as producing gas, is performed using the wellhead assembly to obtain an amount of gas production. The gas pressure overcomes the flapper valves of the bypass sub, thereby opening the valves, and the gas flows up the wellbore. In this manner the method includes flowing gases to the wellhead assembly.

Figure 14:
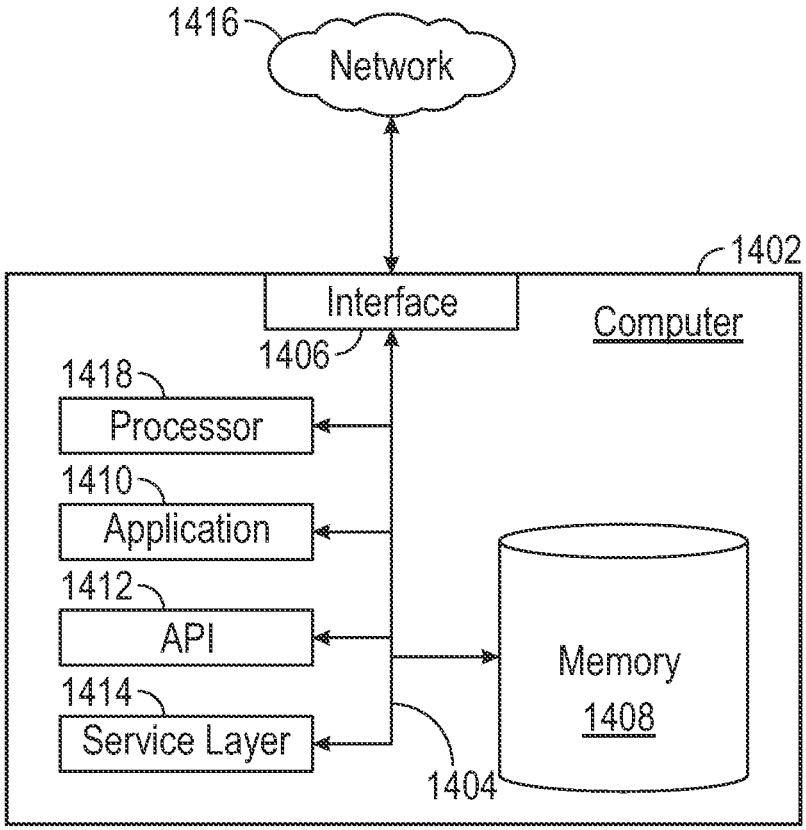
FIG. 14 shows a computer system in accordance with one or more embodiments.

FIG. 14 shows a computer system in accordance with one or more embodiments. Embodiments may be implemented on a computer system. FIG. 14 is a block diagram of a computer system such as the computer 1402 used to provide computational functionalities associated with described algorithms, methods, functions, processes, flows, and procedures as described in the instant disclosure, according to an implementation. The illustrated computer (the computer 1402) is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 1402 may include a computer that includes an input device, such as a keypad, keyboard, touch screen, or other device that can accept user information, and an output device that conveys information associated with the operation of the computer 1402, including digital data, visual, or audio information (or a combination of information), or a graphical user interface.

The computer 1402 can serve in a role as a client, network component, a server, a database or other persistency, or any other component (or a combination of roles) of a computer system for performing the subject matter described in the instant disclosure. The illustrated computer (computer 1402) is communicably coupled with a network 1416. In some implementations, one or more components of the computer 1402 may be configured to operate within environments, including cloud-computing-based, local, global, or other environment (or a combination of environments).

At a high level, the computer 1402 is an electronic computing device operable to receive, transmit, process, store, or manage data and information associated with the described subject matter. According to some implementations, the computer 1402 may also include or be communicably coupled with an application server, e-mail server, web server, caching server, streaming data server, business intelligence server, or other server (or a combination of servers).

The computer 1402 can receive requests over network 1416 from a client application (for example, executing on another computer 1402) and responding to the received requests by processing the said requests in an appropriate software application. In addition, requests may also be sent to the computer 1402 from internal users (for example, from a command console or by other appropriate access method), external or third-parties, other automated applications, as well as any other appropriate entities, individuals, systems, or computers.

Each of the components of the computer 1402 can communicate using a system bus 1404. In some implementations, any or all of the components of the computer 1402, both hardware or software (or a combination of hardware and software), may interface with each other or the interface 1406 (or a combination of both) over the system bus 1404 using an application programming interface (an API 1412) or a service layer 1414 (or a combination of the API 1412 and service layer 1414. The API 1412 may include specifications for routines, data structures, and object classes. The API 1412 may be either computer-language independent or dependent and refer to a complete interface, a single function, or even a set of APIs. The service layer 1414 provides software services to the computer 1402 or other components (whether or not illustrated) that are communicably coupled to the computer 1402. The functionality of the computer 1402 may be accessible for all service consumers using this service layer. Software services, such as those provided by the service layer 1414, provide reusable, defined business functionalities through a defined interface. For example, the interface may be software written in JAVA, C++, or other suitable language providing data in extensible markup language (XML) format or other suitable format. While illustrated as an integrated component of the computer 1402, alternative implementations may illustrate the API 1412 or the service layer 1414 as stand-alone components in relation to other components of the computer 1402 or other components (whether or not illustrated) that are communicably coupled to the computer 1402. Moreover, any or all parts of the API 1412 or the service layer 1414 may be implemented as child or sub-modules of another software module, enterprise application, or hardware module without departing from the scope of this disclosure.

The computer 1402 includes an interface 1406. Although illustrated as a single one of interface 1406, two or more of the interface 1406 may be used according to particular needs, desires, or particular implementations of the computer 1402. The interface 1406 is used by the computer 1402 for communicating with other systems in a distributed environment that are connected to the network 1416. Generally, the interface 1406 includes logic encoded in software or hardware (or a combination of software and hardware) and operable to communicate with the network 1416. More specifically, the interface 1406 may include software supporting one or more communication protocols associated with communications such that the network 1416 or interface's hardware is operable to communicate physical signals within and outside of the illustrated computer (computer 1402).

The computer 1402 includes at least one of a computer processor 1418. Although illustrated as a single one of the computer processor 1418, two or more processors may be used according to particular needs, desires, or particular implementations of the computer 1402. Generally, the computer processor 1418 executes instructions and manipulates data to perform the operations of the computer 1402 and any algorithms, methods, functions, processes, flows, and procedures as described in the instant disclosure.

The computer 1402 also includes a memory 1408 that holds data for the computer 1402 or other components (or a combination of both) that can be connected to the network 1416. For example, memory 1408 can be a database storing data consistent with this disclosure. Although illustrated as a single one of memory 1408, two or more memories may be used according to particular needs, desires, or particular implementations of the computer 1402 and the described functionality. While memory 1408 is illustrated as an integral component of the computer 1402, in alternative implementations, memory 1408 can be external to the computer 1402.

The application 1410 is an algorithmic software engine providing functionality according to particular needs, desires, or particular implementations of the computer 1402, particularly with respect to functionality described in this disclosure. For example, application 1410 can serve as one or more components, modules, applications, etc. Further, although illustrated as a single one of application 1410, the application 1410 may be implemented as a multiple quantity of application 1410 on the computer 1402. In addition, although illustrated as integral to the computer 1402, in alternative implementations, the application 1410 can be external to the computer 1402.

There may be any number of computers such as the computer 1402 associated with, or external to, a computer system containing computer 1402, each computer 1402 communicating over network 1416. Further, the term "client," "user," and other appropriate terminology may be used interchangeably as appropriate without departing from the scope of this disclosure. Moreover, this disclosure contemplates that many users may use one of computer 1402, or that one user may use multiple computers such as computer 1402.

In some embodiments, the computer 1402 is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method comprising:

disposing a packer and an electrical submersible pump assembly (ESP) in a production tubing comprising a production tubing bore, wherein the ESP comprises a pump device, a discharge, a shroud, and a bypass sub coupled to the shroud, wherein the shroud comprises a closed end that is coupled to a pumping base of the pump device, wherein the bypass sub further comprises:

a first flow port configured for fluid communication between the outer surface and a shroud bore, a first flapper comprising a first valve configured to close the first flow port, and a pivot system configured to rotate the first flapper from a first position to a second position, wherein the packer is coupled to an outer surface of the shroud, wherein the packer is located downstream of the bypass sub, and wherein the production tubing is in fluid communication with well fluids containing gases and liquids and the production tubing is configured for delivering the gases and the liquids into a wellhead assembly through the production tubing bore;

circulating, using the pump device, the liquids from the pumping base through the discharge, coupled to a pump outlet, to a shroud open end of the shroud, wherein the shroud open end is downstream of the packer;

forming, using the packer, a seal between the outer surface and the production tubing bore;

pumping, using the pump device, the liquids through the production tubing using the bypass sub, wherein pumping the liquids using the bypass sub comprises closing the first flow port using the pivot system to rotate the first flapper from the first position to the second position; and performing a production operation using the wellhead assembly to obtain an amount of gas production.

2. The method of claim 1 further comprising:

directing the liquids from the shroud open end in a direction toward the packer.

3. The method of claim 1 further comprising:

retrieving the ESP to the wellhead assembly.

4. The method of claim 1, wherein disposing the ESP in the production tubing comprises:

coupling the ESP to a cable using a cable adapter; and deploying the ESP using the cable.

5. The method of claim 1, wherein providing fluid communication further comprises:

coupling a tail pipe to the pumping base wherein the tail pipe is configured for fluid communication between the pumping base and the liquids; and submerging the tail pipe in the liquids.

6. The method of claim 1, wherein flowing the gases to the wellhead assembly further comprises opening a second flow port disposed in the bypass sub for gas flow to bypass the pump device, wherein a spring holds a second flapper comprising a second valve to prevent flow through the second flow port.

7. The method of claim 1, wherein flowing the gases to the wellhead assembly further comprises:

recording a downhole pressure and a downhole temperature, using a control system electrically connected to a monitoring sub coupled to the ESP.

8. The method of claim 1, wherein flowing the gases to the wellhead assembly further comprises:

recording a gas flowrate, using a control system electrically connected to a flowrate instrument coupled to the wellhead assembly.

9. The method of claim 1, wherein flowing gases to the wellhead assembly further comprises:

recording a gas pressure, using a control system electrically connected to a pressure sensor coupled to the wellhead assembly, and recording a gas temperature, using the control system electrically connected to a temperature sensor coupled to the wellhead assembly.

10. The method of claim 1, wherein retrieving the ESP comprises:

pulling a cable, using a cable reel, to disengage the packer, spooling back the cable to the cable reel to retrieve the ESP, flowing the gases unrestricted up the production tubing, and carrying liquid condensation droplets to the wellhead assembly.

11. A system comprising:

a packer and an electrical submersible pump assembly (ESP) disposed in a production tubing comprising a production tubing bore;

wherein the ESP comprises a pump device, a discharge, a shroud, and a bypass sub coupled to the shroud;

wherein the shroud comprises a closed end configured to be coupled to a pumping base of the pump device;

wherein the bypass sub further comprises:

a first flow port configured for fluid communication between the outer surface and a shroud bore, a first flapper comprising a first valve configured to close the first flow port, and a pivot system configured to rotate the first flapper from a first position to a second position, wherein the packer is configured to be coupled to an outer surface of the shroud;

wherein the packer is located downstream of the bypass sub;

wherein the production tubing is in fluid communication with well fluids containing gases and liquids and the production tubing is configured for delivering the gases and the liquids into a wellhead assembly through the production tubing bore; and a pump outlet coupled to the discharge configured to direct liquids pumped by the pump device from the pumping base through the discharge to a shroud open end.

12. The system of claim 11, wherein the shroud open end is configured to direct the liquids in a direction toward the packer.

13. The system of claim 11, wherein the ESP is configured to be retrieved to the wellhead assembly.

14. The system of claim 11 further comprising:

a cable adapter configured for coupling a cable to the ESP;

wherein the cable is configured for deploying the ESP.

15. The system of claim 11 further comprising:

a tail pipe coupled to the pumping base, wherein the tail pipe is configured for fluid communication between the pumping base and the liquids;

wherein the tail pipe is configured to be submerged in the liquids.

16. The system of claim 11 further comprising:

a second flow port disposed in the bypass sub and configured for a gas flow to bypass the pump device, wherein a spring holds a second flapper comprising a second valve to prevent flow through the second flow port.

17. The system of claim 16, wherein the gas flow further comprises liquid condensation droplets.

18. The system of claim 11 further comprising:

a control system electrically connected to a monitoring sub coupled to the ESP and configured to record a downhole pressure and a downhole temperature.

19. The system of claim 11 further comprising:

a control system electrically connected to a flowrate instrument configured to record a gas flowrate at the wellhead assembly.

20. The system of claim 11 further comprising:

a control system electrically connected to:

a gas pressure sensor configured to record a gas pressure at the wellhead assembly, and a gas temperature sensor configured to record a gas temperature at the wellhead assembly.

21. The system of claim 11 further comprising:

a cable coupled to a cable reel configured to disengage the packer and to retrieve the ESP.

22. The system of claim 14, wherein the cable comprises an ESP power cable.

23. The system of claim 11, wherein the packer comprises a swellable packer configured to expand and form an annular seal between the outer surface and the production tubing bore when activated by exposure to the liquids.

* * * * *